US012760982B2

(12) United States Patent
Geissele et al.

(10) Patent No.: US 12,760,982 B2
(45) Date of Patent: Oct. 13, 2026

(54) FIREARM SUPPRESSOR

(71) Applicant: WHG Properties, LLC, North Wales, PA (US)

(72) Inventors: William H. Geissele, Lower Gwynedd, PA (US); Frank E. Robinson, Schwenksville, PA (US)

(73) Assignee: WHG PROPERTIES, LLC, North Wales, PA (US)

( * ) Notice: Subject to any disclaimer, the term of this patent is extended or adjusted under 35 U.S.C. 154(b) by 1 day.

(21) Appl. No.: 18/917,407

(22) Filed: Oct. 16, 2024

(65) Prior Publication Data

US 2025/0035396 A1 Jan. 30, 2025

Related U.S. Application Data

(63) Continuation-in-part of application No. 17/817,437, filed on Aug. 4, 2022, now Pat. No. 12,135,180.

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 1,066,898 A 7/1913 Gray
1,427,802 A * 9/1922 Goodwin ..... F41A 21/30 89/14.3
1,605,864 A * 11/1926 Steinegger ..... F41A 21/30 89/14.3
2,402,632 A 6/1946 Ivanovic
2,514,996 A 7/1950 Faust, Jr.
4,307,652 A 12/1981 Witt
4,939,977 A 7/1990 Stroup
6,575,074 B1 6/2003 Gaddini
7,587,969 B2 9/2009 Silvers
7,856,914 B2 12/2010 Shults et al.
(Continued)

FOREIGN PATENT DOCUMENTS

DE 305012 C 1/1920
EP 2653821 A1 10/2013
KR 10-1882415 B1 7/2018

OTHER PUBLICATIONS

Extended European Search Report for EP Patent Application No. 23178453.9 dated Dec. 4, 2023 (9 pages).

*Primary Examiner* — Benjamin S Gomberg
(74) *Attorney, Agent, or Firm* — Alston & Bird LLP

(57) ABSTRACT

Various systems, methods, and apparatuses related to a firearm suppressor are provided. An example suppressor for a firearm includes an inner body and an external shroud. The inner body may include a muzzle attachment portion and a plurality of baffles. The baffles may each define an opening, and the openings of the plurality of baffles may collectively define a linear projectile path through the inner body along an axis extending from a proximal end of the suppressor to a distal end of the suppressor defining an exit opening. The external shroud may removably couple to and at least partially cover the inner body. The external shroud may permit at least a portion of propellent gas within the inner body to exit the suppressor via a secondary opening defined between the inner body and the external shroud.

20 Claims, 17 Drawing Sheets

(56) References Cited

U.S. PATENT DOCUMENTS

| | | | | |
|---|---|---|---|---|
| 8,171,840 | B2 | 5/2012 | Kline et al. | |
| 8,322,266 | B2 | 12/2012 | Presz | |
| 8,453,789 | B1 | 6/2013 | Honigmann et al. | |
| 8,516,941 | B1 | 8/2013 | Oliver | |
| 8,528,691 | B1 * | 9/2013 | Carmichael | F41A 21/30 89/14.3 |
| 8,695,475 | B2 | 4/2014 | Schneider | |
| 8,739,922 | B2 | 6/2014 | Wirth et al. | |
| 8,910,745 | B2 | 12/2014 | Latka | |
| 8,967,325 | B1 | 3/2015 | Cronhelm | |
| 8,973,481 | B2 | 3/2015 | Dueck et al. | |
| 9,052,152 | B2 | 6/2015 | Moss et al. | |
| 9,273,920 | B2 | 3/2016 | Clarke et al. | |
| 9,347,727 | B1 * | 5/2016 | Cler | F41A 21/30 |
| 9,500,427 | B1 * | 11/2016 | Larue | F41A 21/30 |
| 9,933,224 | B2 | 4/2018 | Dorne et al. | |
| 10,126,084 | B1 | 11/2018 | Oglesby | |
| 10,386,146 | B2 | 8/2019 | Spector | |
| 10,429,146 | B2 | 10/2019 | Garst et al. | |
| 10,746,491 | B2 | 8/2020 | Garst et al. | |
| 10,753,699 | B2 | 8/2020 | Klett et al. | |
| 10,809,032 | B1 * | 10/2020 | Thomas | F41A 21/44 |
| 10,890,403 | B2 | 1/2021 | Petersen | |
| 11,268,776 | B1 | 3/2022 | Noonan | |
| 11,668,540 | B2 | 6/2023 | Spector | |
| 2008/0148928 | A1 * | 6/2008 | McClellan | F41A 21/30 89/14.4 |
| 2010/0199834 | A1 | 8/2010 | Dueck et al. | |
| 2014/0216237 | A1 | 8/2014 | Butler | |
| 2014/0224574 | A1 | 8/2014 | Latka | |
| 2014/0318887 | A1 * | 10/2014 | Latka | F41A 21/30 181/296 |
| 2016/0209151 | A1 | 7/2016 | Smith | |
| 2017/0205175 | A1 | 7/2017 | Garst | |
| 2017/0299312 | A1 | 10/2017 | Llewellyn, Jr. | |
| 2017/0350669 | A1 | 12/2017 | Latka | |
| 2018/0135932 | A1 * | 5/2018 | Tomczak | F41A 21/30 |
| 2018/0293160 | A1 | 10/2018 | Van Schaik | |
| 2018/0313626 | A1 | 11/2018 | Tomczak | |
| 2019/0017767 | A1 * | 1/2019 | Griffis | F41A 21/30 |
| 2019/0072353 | A1 * | 3/2019 | Slack | F41A 21/30 |
| 2019/0285375 | A1 | 9/2019 | Hartwell | |
| 2020/0141679 | A1 * | 5/2020 | Garst | F41A 21/30 |
| 2021/0071979 | A1 * | 3/2021 | Plunkett, Jr. | F41A 21/30 |
| 2022/0170712 | A1 | 6/2022 | Engelbreit | |
| 2022/0276016 | A1 | 9/2022 | Dueck | |
| 2023/0100384 | A1 | 3/2023 | Kunsky | |

* cited by examiner

FIREARM SUPPRESSOR

CROSS-REFERENCE TO RELATED APPLICATIONS

This patent application is a continuation-in-part of U.S. application Ser. No. 17/817,437 filed Aug. 4, 2022, the contents of which are incorporated herein by reference in its entirety.

TECHNICAL FIELD

The present disclosure relates to a firearm suppressor with a shroud. In various embodiments, the shroud may be removable and may facilitate cooling of the suppressor.

BACKGROUND

Discharging a firearm, via ignition of a propellent, creates significant noise that may damage the hearing of a user or otherwise be undesirable. The ignited propellent may also stress and heat various components of the firearm. Typically, suppressors attach to or are integrally mounted on the muzzle end of a firearm to reduce the report created by the firearm by slowing and cooling the high-pressure gasses exiting the muzzle of the firearm following ignition of the propellent (e.g., muzzle blast).

If the firearm is fired for an extended period of time and/or using high temperature rounds, the suppressor may overheat and deform, in some instances causing catastrophic failure if a projectile strikes the suppressor itself. Moreover, in some instances, propellent gas may build up in the chamber of the firearm, which may lead to mechanical over-cycling. Through applied effort, ingenuity, and innovation, Applicant has solved problems relating to suppressors by developing solutions embodied in the present disclosure, which are described in detail below.

BRIEF SUMMARY

The present disclosure relates to firearm suppressors, firearms, and corresponding methods and systems. According to some embodiments of the present disclosure, a suppressor for a firearm may be provided. The suppressor may define a distal end and a proximal end, and the suppressor may include an inner body and an external shroud. The inner body may include a muzzle attachment portion defined at or proximate the proximal end of the suppressor and a plurality of baffles each defining an opening, wherein the openings of the plurality of baffles collectively define a linear projectile path through the inner body along an axis extending from a proximal end of the suppressor to a distal end of the suppressor defining an exit opening, wherein an expansion chamber is defined between the muzzle attachment portion and one of the plurality of baffles. The external shroud may be configured to at least partially cover the inner body, wherein the external shroud is configured to permit at least a portion of propellent gas within the inner body to exit the suppressor via a secondary opening disposed at a location between one of the plurality of baffles and the proximal end of the suppressor.

In various embodiments, the external shroud may bound at least a portion of the expansion chamber. The external shroud may include threading configured to engage the inner body. The threading of the external shroud may be configured to thread onto a protrusion defined at a distal end of the inner body. In some embodiments, the suppressor may include a nut configured to thread onto the inner body, wherein a portion of the external shroud is configured to be disposed between the inner body and the nut. In some embodiments, the nut is threaded onto a protrusion defined at a distal end of the inner body. The suppressor may include one or more additional openings at the distal end of the suppressor. In some embodiments, the one or more additional openings may be oriented linearly forward parallel to the linear projectile path and fluidically connected to the expansion chamber. The one or more additional openings may be defined in the external shroud. The one or more additional openings may be defined in a front portion of the external shroud. In some embodiments, the inner body is open on at least one side to permit cleaning of an interior of the inner body between two or more of the plurality of baffles in an instance in which the external shroud is removed. The inner body may be open in two opposite sides. The inner body may be bilaterally symmetric about a plane intersecting the linear projectile path. In some embodiments, the secondary opening may include a gap between the external shroud and the inner body. The external shroud may include a material that is configured to expand when heated. The inner body may define a flange configured to engage a proximal end of the external shroud. The flange may define a labyrinth structure configured to define one or more flow directional convolutions between the flange and the external shroud. In some embodiments, the flange includes a lip defining a groove in the flange, wherein the proximal end of the external shroud is configured to engage the groove. In some embodiments, the secondary opening is defined between the proximal end of the external shroud and the flange.

Various embodiments may include a suppressor for a firearm defining a distal end and a proximal end. The suppressor may include an inner body and an external shroud. The inner body may include a muzzle attachment portion and a plurality of baffles each defining an opening. The openings of the plurality of baffles may collectively define a linear projectile path through the inner body along an axis extending from a proximal end of the suppressor to a distal end of the suppressor defining an exit opening. An expansion chamber may be defined between the muzzle attachment portion and one of the plurality of baffles. The external shroud may be configured to removably couple to and at least partially cover the inner body. The external shroud may be configured to permit at least a portion of propellent gas within the inner body to exit the suppressor via a secondary opening defined between the inner body and the external shroud.

In some embodiments, the external shroud bounds at least a portion of the expansion chamber. The external shroud may include threading configured to engage the inner body.

The suppressor may further include one or more additional openings at the distal end of the suppressor. The one or more additional openings may be oriented linearly forward parallel to the linear projectile path and fluidically connected to the expansion chamber. The one or more additional openings may be defined in the inner body.

The inner body may be open on at least one side such that the inner body is configured to permit the portion of propellant gas to exit the inner body towards the external shroud. The inner body may define a flange configured to engage a proximal end of the external shroud.

The inner body may define a flange configured to engage a distal end of the external shroud. The flange may be disposed at a distal end of the inner body. In some embodiments, the flange may at least partially define a distal end surface at the distal end of the inner body. The distal end surface may further include the exit opening. The inner body may define a threaded portion extending circumferentially about a portion of the muzzle attachment portion.

In some embodiments, the external shroud may include a threaded portion at one of the distal end or the proximal end. The inner body may define a flange. The flange may include a labyrinth structure configured to define one or more flow directional convolutions between the flange and the external shroud. The flange may define a circumferential groove, and the proximal end of the external shroud may be configured to insert into the groove. The secondary opening may be defined between the proximal end of the external shroud and the flange. In some embodiments, the flange defines a flange diameter perpendicular to the axis. The flange diameter may be greater than the greatest diameter of the external shroud.

Various embodiments may include a firearm. The firearm may include a barrel and a suppressor. The suppressor may include a distal end and a proximal end, and the suppressor may comprise an inner body and an external shroud. The inner body may include a muzzle attachment portion and a plurality of baffles each defining an opening. The muzzle attachment portion may be defined at or proximate the proximal end of the suppressor. The openings of the plurality of baffles may collectively define a linear projectile path through the inner body along an axis extending from a proximal end of the suppressor to a distal end of the suppressor defining an exit opening. An expansion chamber may be defined between the muzzle attachment portion and one of the plurality of baffles. The external shroud may be configured to removably couple to and at least partially cover the inner body. The external shroud may be configured to permit at least a portion of propellent gas within the inner body to exit the suppressor via a secondary opening defined between the inner body and the external shroud.

In various embodiments, a method of assembling a suppressor may be provided. The suppressor may define a distal end and a proximal end. The suppressor may include an inner body and an external shroud. The inner body may include a muzzle attachment portion defined at or proximate the proximal end of the suppressor and a plurality of baffles each defining an opening. The method may include inserting the inner body into the external shroud until the external shroud at least partially covers the inner body. The method may further include removably coupling the inner body to the external shroud, such that the inner body and the external shroud are fixed relative to each other. The external shroud may be configured to permit at least a portion of propellent gas within the inner body to exit the suppressor via a secondary opening defined between the inner body and the external shroud. The external shroud comprises a proximal end and a distal end. One of the proximal end or the distal end may define a threaded portion. Inserting the inner body into the external shroud may include inserting the inner body into the threaded portion from the other of the proximal end or the distal end opposite the threaded portion.

According to some embodiments of the present disclosure, a barrel, barrel assembly, and/or firearm comprising any embodiment of the suppressor herein may be provided.

The above summary is provided merely for the purposes of summarizing some example embodiments to provide a basic understanding of some aspects of the present disclosure. Accordingly, it will be appreciated that the above-described embodiments are merely examples and should not be construed to narrow the scope or spirit of the present disclosure in any way. It will be appreciated that the scope of the present disclosure encompasses many potential embodiments in addition to those here summarized, some of which will be further described below. Other features, aspects, and advantages of the subject will become apparent from the description, the drawings, and the claims.

BRIEF DESCRIPTION OF THE DRAWINGS

The following drawings are illustrations of a particular embodiments of the present disclosure and therefore do not limit the scope of the present disclosure. The drawings are not drawn to scale and are intended for use in conjunction with the explanation in the following detailed description.

DETAILED DESCRIPTION

Figure 1:
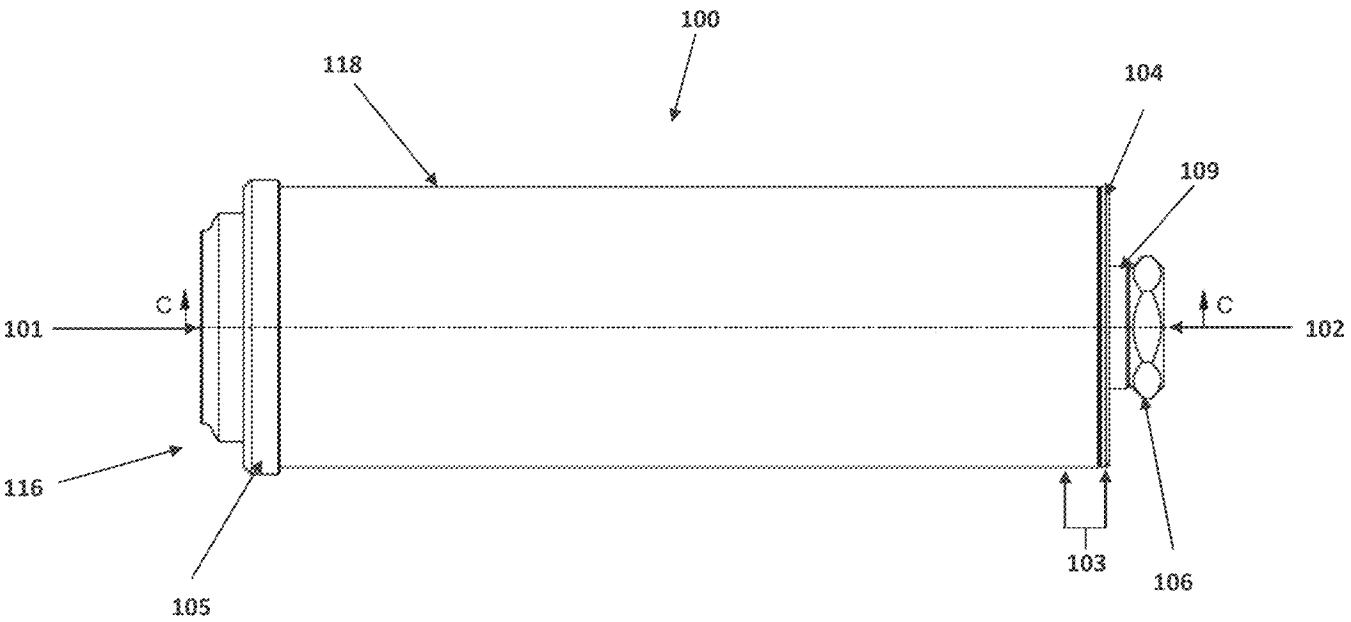
FIG. 1 illustrates a side view of an example suppressor in accordance with some embodiments of the present disclosure.

Some embodiments of the present invention will be described in a more detailed manner hereinafter with reference to the accompanying drawings, in which some, embodiments of the invention are shown. Reference numbers refer to elements throughout the drawings. Multiple embodiments of the current invention may be embodied in different forms and should not be limited to the embodiments set forth herein. Rather, these embodiments are provided so that this disclosure will satisfy applicable legal requirements.

As used herein, terms such as "front," "rear," "top," etc. are used for explanatory purposes in the examples provided below to describe the relative positions of certain components or portions of components. As used herein, the term "or" is used in both the alternative and conjunctive sense, unless otherwise indicated. The term "along," and similarly utilized terms, means near or on, but not necessarily requiring directly on an edge or other referenced location. The terms "approximately," "generally," and "substantially" refer to within manufacturing and/or engineering design tolerances for the corresponding materials and/or elements unless otherwise indicated. The use of such terms is inclusive of and is intended to allow independent claiming of specific values listed. Thus, use of any such aforementioned terms, or similarly interchangeable terms, should not be taken to limit the spirit and scope of embodiments of the present invention. As used in the specification and the appended claims, the singular form of "a," "an," and "the" include plural references unless otherwise stated. The terms "includes" and/or "including," when used in the specification, specify the presence of stated feature, elements, and/or components; it does not preclude the presence or addition of one or more other features, steps, operations, elements, components, and/or groups thereof.

The figures of the current embodiment of the invention are not drawn to scale and are provided to illustrate some examples of the invention described. The figures are not to limit the scope of the present embodiment of the invention or the appended claims. Aspects of the example embodiment are described below with reference to example applications for illustration. It should be understood that specific details, relationships, and methods are set forth to provide a full understanding of the example embodiment. One of ordinary skill in the art recognize the example embodiment can be practice without one or more specific details and/or with other methods.

Suppressors for firearms according to various embodiments of the present disclosure may include the inner body portion that is used to dampen the noise from the small explosion the firearm produces. The inner body may include one or multiple components configured to permit passage of a projectile. For example, suppressors according to various embodiments may use different shape baffles (e.g., flat baffles, conical baffles, angled baffles, symmetric baffles, asymmetric baffles, etc.) having concentric openings to permit passage of the projectile while slowing the gasses exiting the barrel to expand and cool the gas and reduce the report of the firearm.

The high pressure and high temperature gases exiting the barrel into the suppressor may cause the suppressor to heat up. Sustained firing and heat accumulation may result in failure and/or insufficient or reduced noise reduction. For example, suppressors may use baffles disposed along a line of travel of the projectile at the end of a barrel to guide the propellent gas that is exiting the muzzle into an expansion chamber and/or into secondary chamber(s) within the suppressor. These series of baffles and expansion chambers, however, may cause the suppressor to be over tuned to suppress the noise level. When the firearm is repeatedly discharged, the over tuning for suppression allows for buildup of excess gas within the expansion chambers, herein causing the suppressor to overheat. In some instances, however, the suppressor may be tuned to avoid overheating with excess ventilation for the propellent gas and/or too few baffles. The result from excess ventilation may produce too little noise reduction causing hearing damage to the operator.

Embodiments of the present disclosure, as described hereinafter, may operate to reduce noise level produced by the firearm from the discharged gas without overheating the suppressor. In some embodiments, the suppressor may include ventilation in the form of one or more secondary openings configured to minimize suppression loss while allowing additional ventilation of the interior of the suppressor. For example, the embodiments described hereinafter may provide a suppressor with at least a first expansion chamber followed by at least one secondary chamber along the length of the suppressor's body, wherein the expansion chamber may be closer to the muzzle end of the firearm at a proximal end of the suppressor relative to the at least one second chamber. The expansion chamber may allow a first portion of propellent gas to expand partially after it exits the barrel, which reduces a second amount of gas that expands within the second chamber and reduces the gas pressure. The more distal secondary chamber provides a further sound damping effect by allowing the propellent gas that travels past the expansion chamber to also expand further.

In some embodiments, an external shroud of the suppressor is disposed over the inner body to cover at least a portion of the inner body (e.g., to cover at least a portion of the expansion chamber and/or second chamber(s)). The shroud may be connected to the inner body via at least one connection point, and in some embodiments, the shroud or a portion thereof may be removable for cleaning the suppressor. In some embodiments, the shroud and inner body may not rigidly attached other than the at least one connection point to allow for relative expansion between the shroud and inner body to prevent binding or warping of the components of the suppressor and inaccuracy or failure of the firearm. In some embodiments, the shroud may be removably threaded onto a protrusion defined at the distal end of the inner body. In some embodiments, a threaded nut may at least partially secure the external shroud to the protrusion.

In some embodiments, a portion of the shroud and/or the inner body has a plurality of port holes to allow excess gas ventilation. In some embodiments, a secondary opening may be present or may open in at least some temperature and pressure conditions between the external shroud and the inner body to allow ventilation of the suppressor. In some embodiments, the secondary opening may be configured to allow airflow therethrough at room temperature, while in some embodiments, the secondary opening may be closed at room temperature. In some embodiments, the external shroud may cooperate with a groove on a flange of the inner body and a space between the external shroud and inner body may define the second opening. In some embodiments, a loose, non-rigid and non-fixed engagement between the proximal end of the external shroud and the inner body (e.g., as defined by the flange and rear support surface in some embodiments discussed herein) may prevent the proximal end of the shroud from binding on the inner body and distorting one or both components. Herein the example embodiment allows for more ventilation as the shroud heats and expands due to repeated discharging of the firearm while still maintaining vital noise reduction.

Embodiments of the present disclosure relates generally to a firearm suppressor, and more specifically, to a firearm suppressor with a shroud configured to provide additional ventilation while maintaining suppression. Non-limiting embodiments of the firearm suppressor are described below with reference to FIGS. 1-21. In various embodiments, the suppressor may be used with an AR-15 platform weapon. The embodiment may be used with a plurality of different ammunition calibers and with a plurality of different types of firearms. For example, some embodiments may include any type of automatic firearms or semi-automatic firearms.

FIGS. 1-11 depict example views of an example suppressor 100 and portions thereof in accordance with various embodiments of the present disclosure. The example embodiment of a suppressor 100 depicted in the figures includes a muzzle opening 101 at a proximal end and exit opening 102 at a distal end of a suppressor 100. The depicted suppressor is configured to attach to the muzzle of a firearm barrel (e.g., via threads 110 shown in FIG. 5). With reference to FIG. 1, the suppressor 100 may include an external shroud 103, including a front portion 104, engaged with and at least partially surrounding an inner body 116 having a rear base 105. A nut 106 or other fastener may be engaged with the inner body 116 to at least partially secure the external shroud 103 to the inner body.

Figure 2:
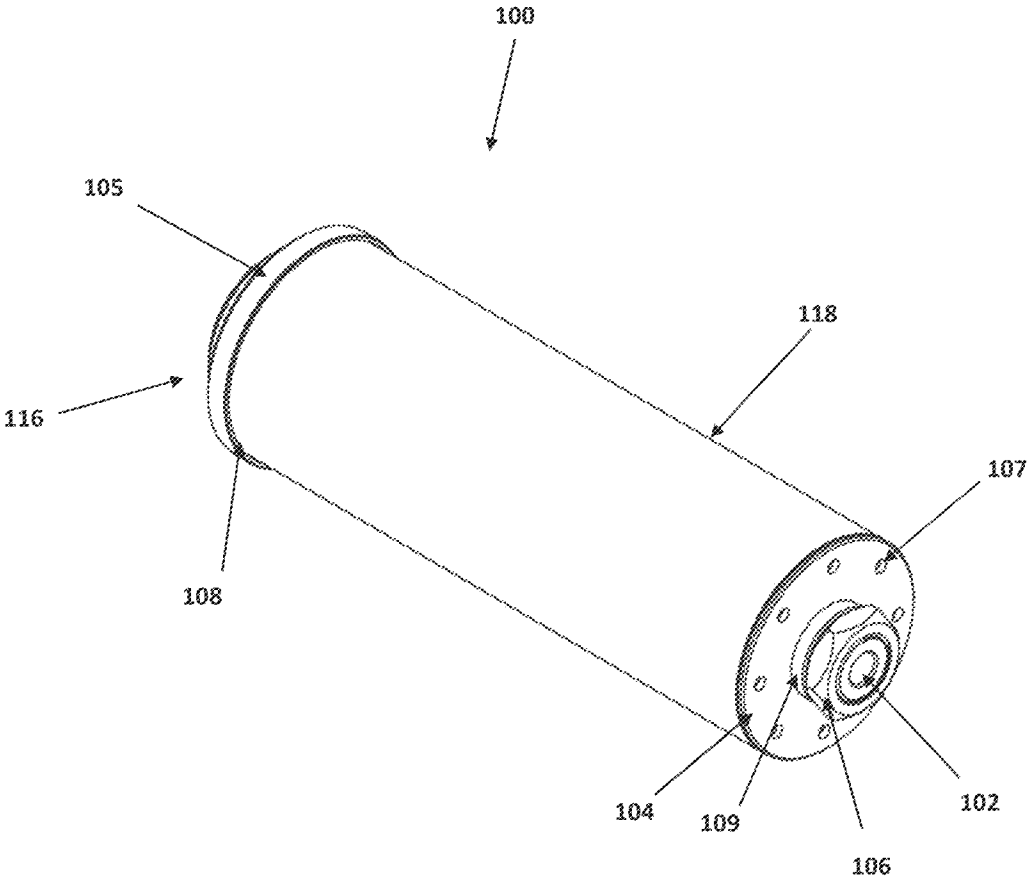
FIG. 2 illustrates a front-perspective view of the suppressor of FIG. 1 in accordance with some embodiments of the present disclosure.
Figure 7:
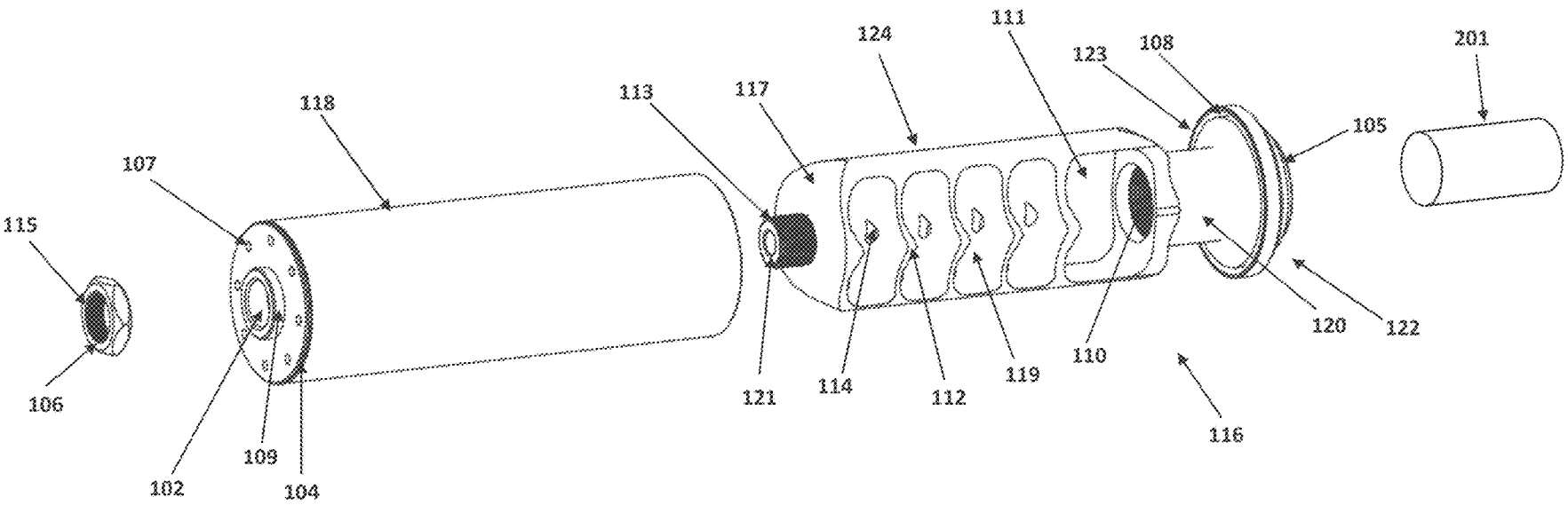
FIG. 7 illustrates an exploded view of the assembly of the suppressor of FIG. 1 and firearm in accordance with some embodiments of the present disclosure.
Figure 8:
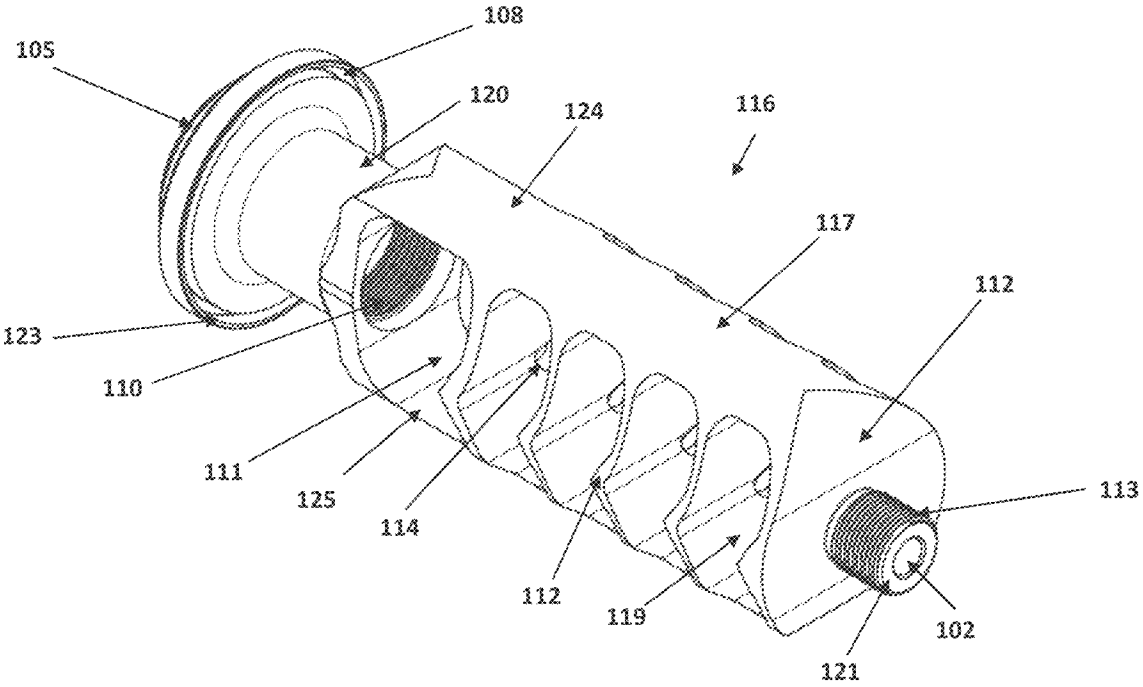
FIG. 8 illustrates a front-perspective view of the inner body of the suppressor of FIG. 1 in accordance with some embodiments of the present disclosure.
Figure 9:
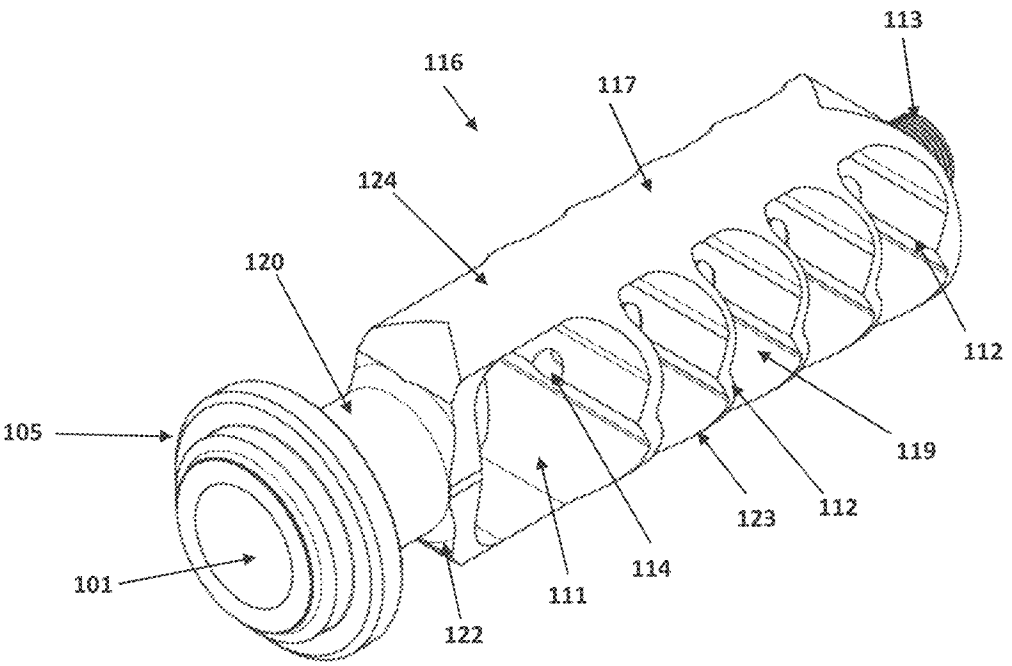
FIG. 9 illustrates a rear-perspective view of the inner body of the suppressor of FIG. 1 in accordance with some embodiments of the present disclosure.

With reference to FIG. 2, the depicted suppressor contains one or more additional opening(s) 107 on the front portion 104 of the external shroud 103 of the suppressor and a secondary opening at a rear support surface of a flange of the inner body (e.g., rear groove 123 in FIG. 7). In one or more embodiments, the suppressor 100 includes a plurality of additional openings 107 such as, but not limited to, two, three, four, five, six, seven, eight, nine, or more additional openings 107.

Figure 5:
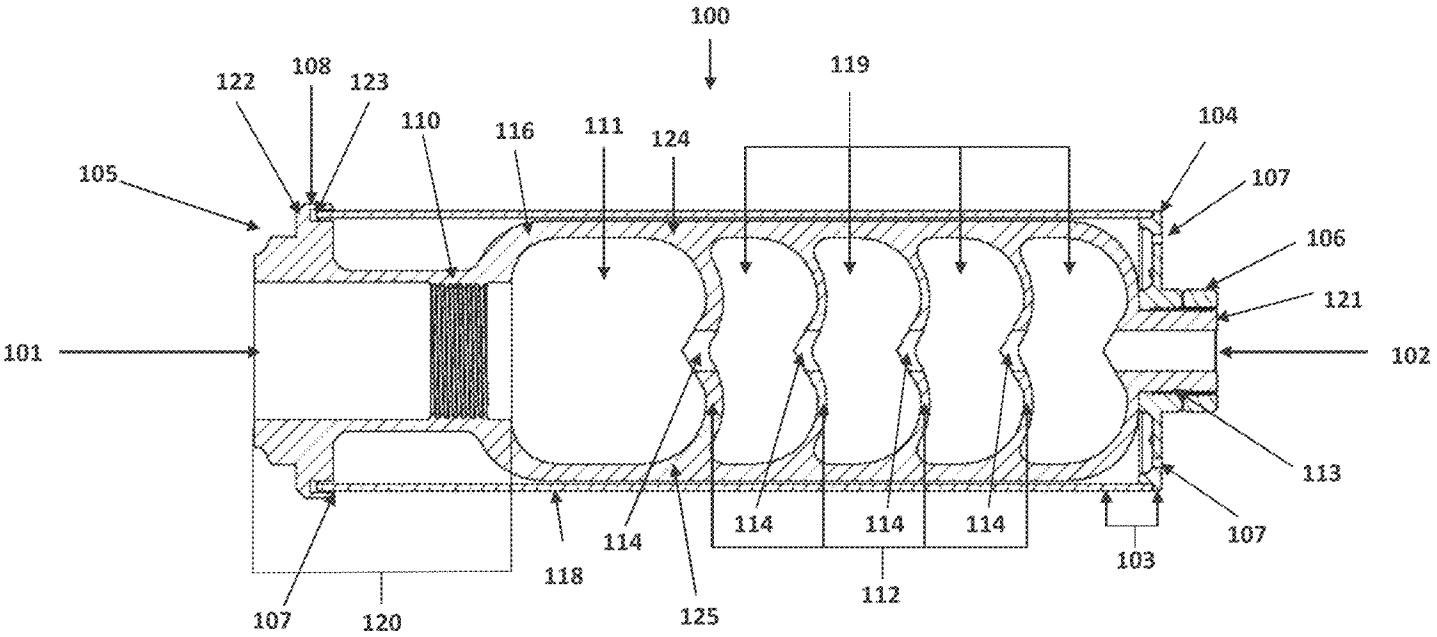
FIG. 5 illustrates a cross-sectional view of the suppressor of FIG. 1 in accordance with some embodiments of the present disclosure.
Figure 6:
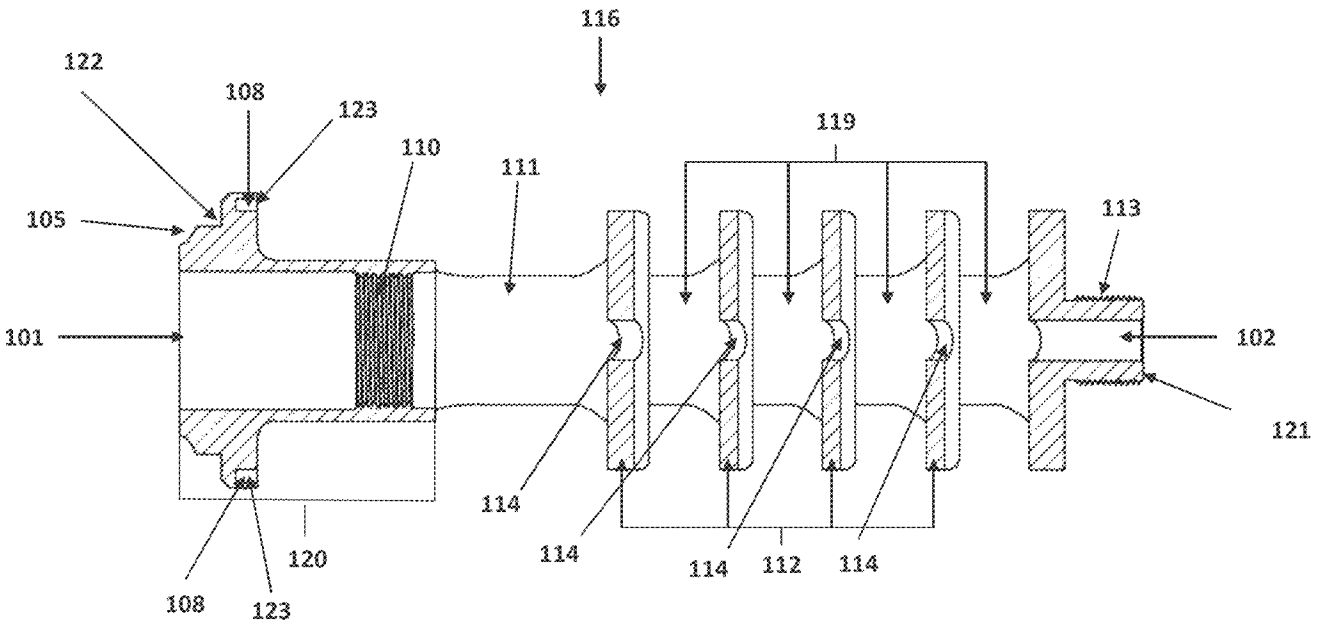
FIG. 6 illustrates a cross-sectional view of the example inner body of the suppressor of FIG. 1 taken ninety degrees rotated relative to the view shown in FIG. 5.

In some embodiments, external shroud 103 may comprise the front portion 104 and an outer cylindrical sleeve 118 of the external shroud 103 as two different pieces attached to each other. In some embodiments, the front portion 104 may be integral with the rest of the external shroud 103 as a single piece. In some embodiments, the front portion 104 engages the cylindrical sleeve 118 via placement into a circumferential slot or by inserting the front portion into an inner diameter of the cylindrical sleeve 118 (e.g., via press-fitting, slip-fitting, set screw, adhesive, welding, or the like). In some embodiments, the front portion 104 loosely, slidingly engages the cylindrical sleeve 118 and the cylindrical sleeve is abutted and retained by an outer rim of the front portion. As depicted in FIG. 5, the cylindrical sleeve 118 covers the inner body 116 at least partially, while engaging a flange portion 122 of the inner body 116 at or proximate the proximal end. In the depicted example embodiment, during assembly, the front portion 104 slides over the distal protrusion 121 to engage with the cylindrical sleeve, wherein the front portion 104 is secured to the cylindrical sleeve via a fastener 106 (e.g., nut) fastening onto distal threading 113 located on the distal protrusion 121.

In some embodiments, the flange 122 of the inner body 106 may have one or more support surfaces configured to constrain and, in some instances, contact at least a portion the proximal end of the external shroud 103. The secondary opening described herein may be defined between the support surface of the flange 122 and the external shroud 103. For example, of a flange of the inner body may define a labyrinth structure in which one or more flow-directional convolutions exist in a flow path out of the secondary opening (e.g., one or more right angle and/or curved path around the groove 123, lip 108, and/or other structures described herein). In some embodiments, a groove 123 is configured to receive at least a portion of the external shroud 103 at the flange 122 at or proximate the proximal end of the inner body 116. In some embodiments, the flange 122 may include only an outwardly facing rim (e.g., without a lip 108 on the outside of the flange). In some embodiments, the flange 122 may include only an inwardly facing rim (e.g., a lip 108 on the outside of the flange facing inward without a corresponding inner surface of the groove). As described herein, for each of the foregoing configurations, one or more of the surfaces at the flange 122 (e.g., the groove surfaces, inner rim, outer rim, etc.) may be configured to define a secondary opening, which may be open under at least some heating conditions, between the flange and the external shroud 103 to facilitate suppression and cooling of the suppressor according to the various embodiments herein.

Figure 3:
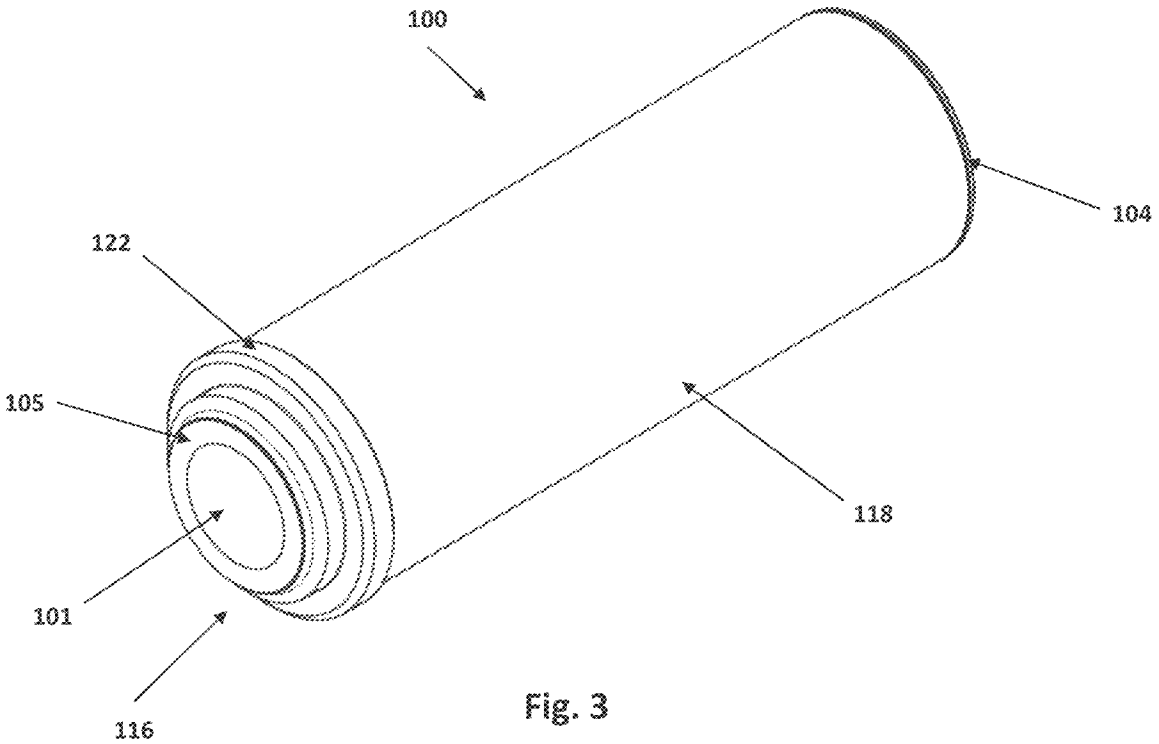
FIG. 3 illustrates a rear-perspective of the suppressor of FIG. 1 in accordance with some embodiments of the present disclosure.

FIG. 3 depicts a rear perspective if the suppressor 100. In this example embodiment, the rear-base portion 105 of the inner body 116 can be seen fitted to the external shroud 103 with the closest end being the proximal end with the muzzle opening 101.

In some embodiments, the external shroud 103 may at least partially cover the inner body 116. In the depicted embodiment of FIG. 5, the external shroud 103 engages with the inner body 116 via threading located on the front portion 104 of the shroud 103. The front portion's threading in the depicted embodiment engages with the distal threading 113 on the distal protrusion 121 of the inner body 116. In some embodiments, the external shroud 103 may be additionally or alternatively secured to the inner body 116 via a threaded fastener (e.g., nut) 106, which the fastener's threading (e.g., nut threading) 115 engages with the distal threading 113 on the distal protrusion 121. In the depicted example embodiment, the external shroud 103 is easily removable from the inner body 116 by unthreading the threaded fastener (e.g., nut) 106 from the distal threading 113 then unthreading the external shroud 103 from the distal threading 113. This embodiment allows for case of access to the expansion chamber 111, one or more secondary chamber(s), and/or other interior parts of the inner body 116 and/or shroud 103 for easy cleaning after repeated use of the firearm. Moreover, in some embodiments, the engagement between the shroud 103 and the distal protrusion 121 may be the only rigid connection between the shroud 103 and the inner body 116, while the proximal end of the inner shroud and the flange 122 of the inner body are at least partly movably disposed relative to each other. In such embodiments, the structure of the suppressor allows for relative expansion between the shroud 103 and inner body 116 and symmetrical engagement between the shroud and inner body at the distal protrusion 121 to prevent the components from binding against each other or warping relative to each other, which may reduce distortion or flexing of the suppressor under heating, thereby reducing the likelihood of failure or inaccuracy.

Figure 4B:
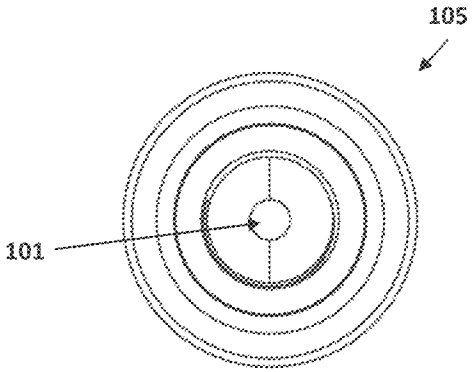
FIG. 4B illustrates a rear view of the suppressor of FIG. 1 in accordance with some embodiments of the present disclosure.
Figure 4A:
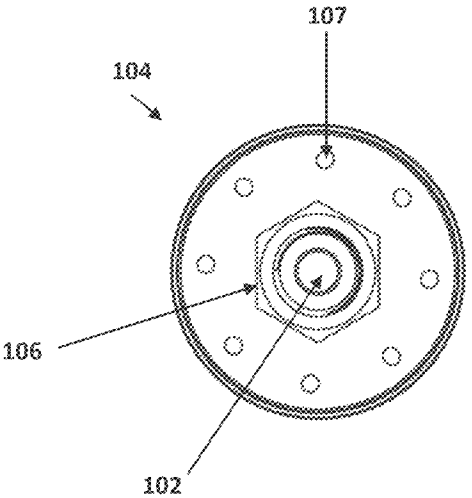
FIG. 4A illustrates a front view of the suppressor of FIG. 1 in accordance with some embodiments of the present disclosure.

In the example embodiment represented by FIGS. 4A-4B, FIG. 4A depicts the front portion 104 of the suppressor 100. In this embodiment, the front portion 104 engages the cylindrical sleeve 118 to form the external shroud 103. In this example embodiment, at least one or more of the additional opening(s) 107 can be seen on the front portion 104. As further depicted, for example, in FIG. 5, the chambers (e.g., expansion chamber 111 and secondary chambers 119) of the suppressor may be fluidically connected to the additional opening(s) 107 at all times during operation of the firearm via a void between the external shroud 103 and the inner body 116. In the example embodiment represented by FIG. 4B, the base portion 105 of the inner body 116 of the suppressor 100 can be seen with the muzzle opening 101.

Figure 10:
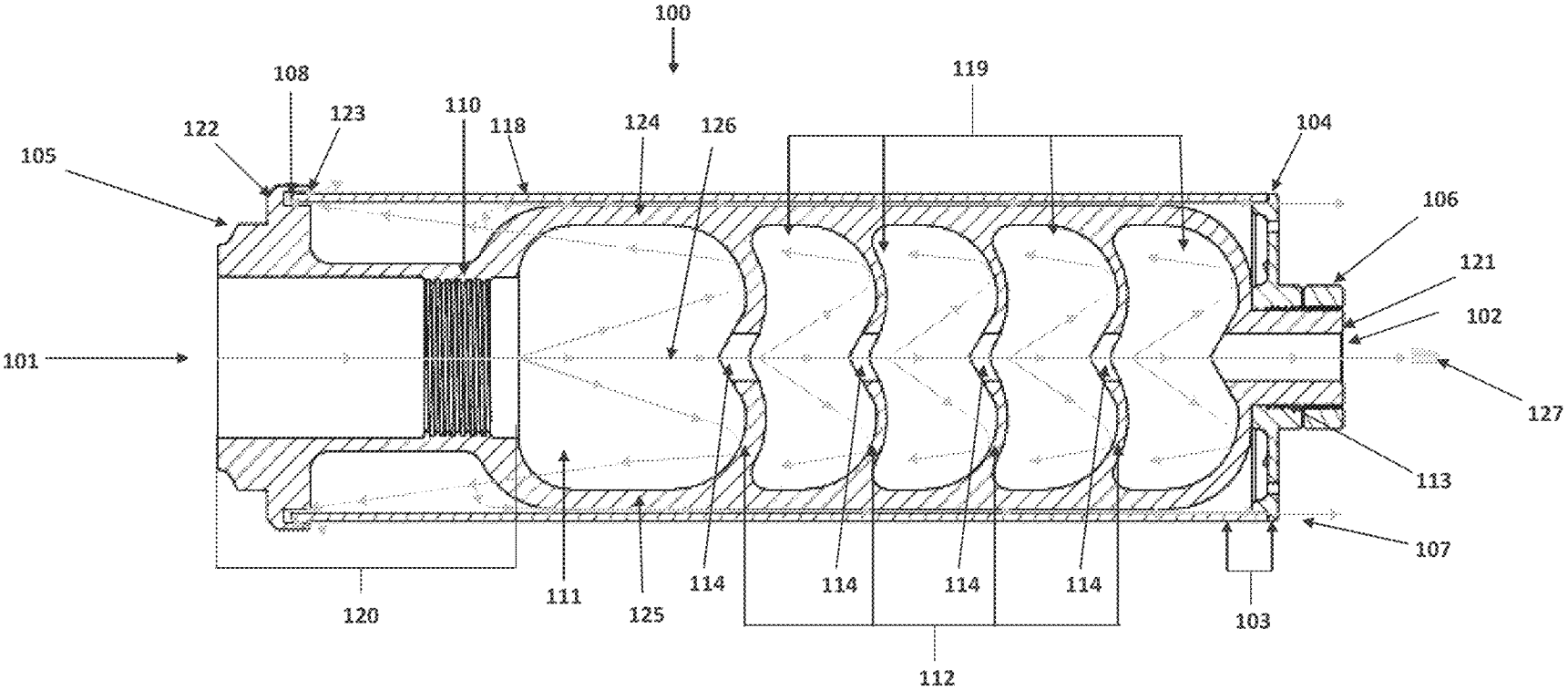
FIG. 10 illustrates a cross-sectional view of the suppressor of FIG. 1, which illustrates the propellent gas flow through the inner body of the example suppressor in accordance with some embodiments of the present disclosure.

In one or more embodiments, the example suppressor 100 may be attached and detached from of the barrel of the firearm via the muzzle opening 101. In the embodiment of FIGS. 5 and 10, the attachment portion 120 (e.g., including the depicted threading 110) is configured to attach to the muzzle of the firearm barrel. For example, the suppressor 100 may be attached to a firearm barrel using the muzzle attachment threading 110 by inserting the barrel into the muzzle opening 101. The example suppressor 100 may be detached from the muzzle by unthreading the suppressor 100 from the threaded portion of the muzzle 110. In various embodiments, the muzzle attachment portion 120 of the suppressor may include a mechanism, and method for attaching and removing (whether permanently or temporarily) the suppressor to/from the firearm. In some embodiments, the muzzle attachment portion may comprise any other connector capable of removably securing the suppressor to the firearm muzzle. In some embodiments, the suppressor may comprise a muzzle device. In some embodiments, the suppressor may be fixedly integrated into the muzzle of the barrel, in which embodiment the muzzle attachment portion may be the contiguous interface between the suppressor and the muzzle section within the integral assembly. Although an opening with internal threading is depicted, one of ordinary skill in the art will appreciate, in light of the present disclosure, that any known attachment device or mechanism may be used to attach the suppressor 100 permanently or temporarily to a firearm barrel (e.g., the firearm 201 shown in FIG. 7). In the depicted embodiment, the external shroud 103, including the cylindrical sleeve 118 and front portion 104, engages the inner body 116 via a threaded fastener (e.g., nut) 106 that threads onto the distal threading 113 on the distal protrusion 121 and engages a front lip portion 109 of the external shroud 103 when tightened, while a proximal end of the cylindrical sleeve 118 at least partially cooperates with a flange portion 122 at the proximal end of the inner body 116 to define the secondary opening(s). For example, the external shroud 103 may slide at least partially into the groove 123 of the base of the inner body 105 on the flange portion 122 and being at least partially surrounded by a lip 108 defining the outer wall of the groove. In some embodiments, the engagement between the inner body 116 and the distal end of the shroud 103 may longitudinally (e.g., along a projectile flight axis) secure the external shroud 103 relative to the inner body 116, while the proximal and distal engagements between the shroud and the inner body 116 provide at least partial radial support and/or movement restriction (e.g., perpendicular to the projectile flight axis).

In one or more embodiments, the inner body 116 and/or the external shroud 103 is made of a material that expands when its temperature is increased from firing (e.g., at least greater than room temperature). In an example embodiment, the inner body 116 and/or the external shroud 103 may comprise titanium. In some embodiments, the inner body 116 and/or external shroud 103 may comprise a heat resisting alloy (e.g., Inconel). In some embodiments, the inner body 116 and/or external shroud 103 may comprise steel, such as stainless steel.

In some example embodiments, propellent gases enter the inner body 116 of the suppressor 100 into the expansion chamber 111 and/or one or more secondary chamber(s) 119. The propellent gases increase the temperature of the external shroud 103 and/or the inner body 116 causing them to expand and shift relative to each other. When heated, the flange portion 122 and groove 123 of the base of the inner body 105 may expand and the external shroud 103 may expand due to increase of temperature. This relative movement may change the size and/or shape of the secondary opening (e.g., enlarging the secondary opening) and may cause the proximal end of the external shroud 103 and/or the flange 122 of the inner body 116 to move longitudinally and/or radially relative to each other.

With continued reference to FIG. 5, the one or more additional opening(s) 107 may be configured to divert propellent gases from the inner body 116 of the suppressor 100 out the distal end of the suppressor 100. In the depicted embodiment, the additional openings 107 are oriented parallel to the projectile flight axis extending from a proximal end of the suppressor to a distal end of the suppressor, and the additional openings 107 are symmetrically oriented and evenly spaced around the axis and the distal protrusion 121. Each of the one or more additional opening(s) 107 may fluidically connect to the expansion chamber 111 and/or one or more secondary chamber(s) 119 and/or one or more secondary opening(s) to divert gas and allow the expanding gas to escape, which may provide additional cooling.

The suppressor 100 may further act to reduce the visible portion (e.g., flash) of the discharge of a firearm. The suppressor 100, for example, may reduce the visible portion by physically concealing the flash leaving the barrel and by containing and/or allowing the slow burning of unburned propellant leaving the barrel. In addition, the suppressor 100 may reduce the recoil of the firearm (e.g., by slowing and/or redirecting the high-pressure gasses leaving the barrel, which contribute to significant portions of the firearm recoil).

In the depicted example embodiment of the suppressor 100, the opening 114 for the projectile 127 can be seen in each of the plurality of baffles 112. The openings 114, 102, 101 along the suppressor 100 collectively define the projectile flight axis. The depicted embodiment of the inner body 116 includes the muzzle opening 101 and an exit opening 102. The external shroud 103, which comprises of the cylindrical sleeve 118 and the front portion 104, is shown engaging the inner body 116 via a threaded fastener (e.g., nut) 106 that is threaded on the distal threading 113 on the distal protrusion 121. Although the inner body 116 is depicted as a single piece, one of ordinary skill in the art will appreciate in light of the present disclosure that the inner body 116 may be made of one or more pieces without departing from the spirit of the disclosure. For example, each baffle wall and chamber may be a separate component abutting the adjacent components to collectively form at least part of the inner body 116. In some such embodiments, the components of the inner body 116 may be, for example, welded together.

The front portion 104 of the contains at least one additional opening 107. In this example embodiment, the inner body 116 is configured to engage the firearm at the muzzle attach threading 110. In the depicted embodiment, within the external shroud 103, an expansion chamber 111 is formed by the inner body and a portion of the external shroud. Similarly, at least one secondary chamber 119 is formed by the inner body and a portion of the external shroud. At least one baffle 112 is configured to divide the chambers and create additional chambers for suppression. The external shroud 103 may be configured to engage the base of the inner body 105 by being positioned partially in the groove 123. The groove 123 and the external shroud 103 define the variable size secondary opening therebetween. For example, the depicted secondary opening is an annular gap between the inner body 116 and external shroud 103.

FIG. 10 shows a cross section and interior configuration of the inner body 116 of an example suppressor 100. In some embodiments, the inner body 116 may include at least one baffle 112 for separating the expansion chamber 111 from an adjacent secondary chamber 119, and one or more baffles 112 that define and separate one of more secondary chamber(s) 119. In the embodiment, the expansion chamber 111 is defined by the area between the cylindrical sleeve 118, the baffle 112, the attachment portion 120, and the top 124 and bottom 125 surfaces of the inner body 116. The expansion chamber may be configured to receive propellent gas from the muzzle opening 101 before a portion of the propellent gas moves through to at least one secondary chamber 119, and/or at least one secondary opening, and/or at least one additional opening 107.

Figure 11:
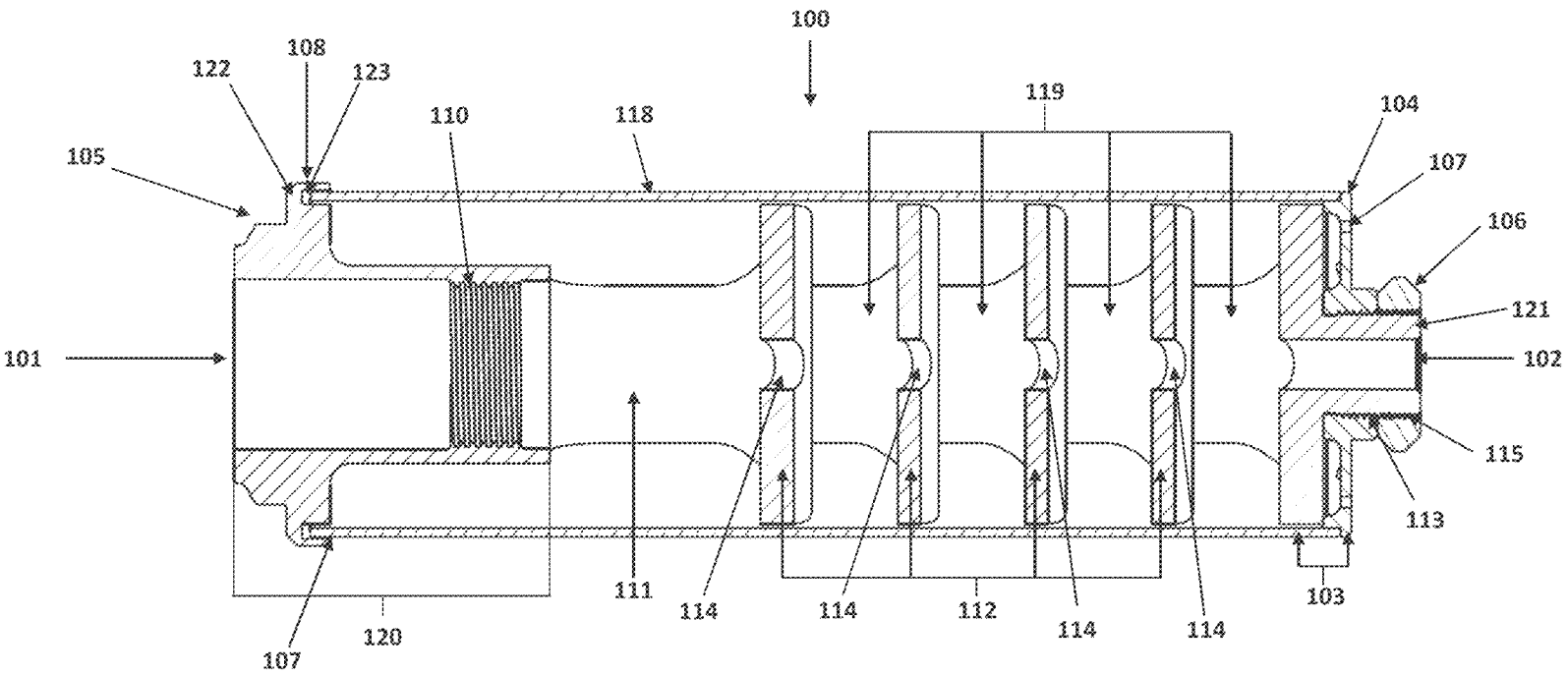
FIG. 11 illustrates a cross-sectional view of the suppressor of FIG. 1, which shows the internal baffles with the external shroud in accordance with some embodiments of the present disclosure.
Figure 12:
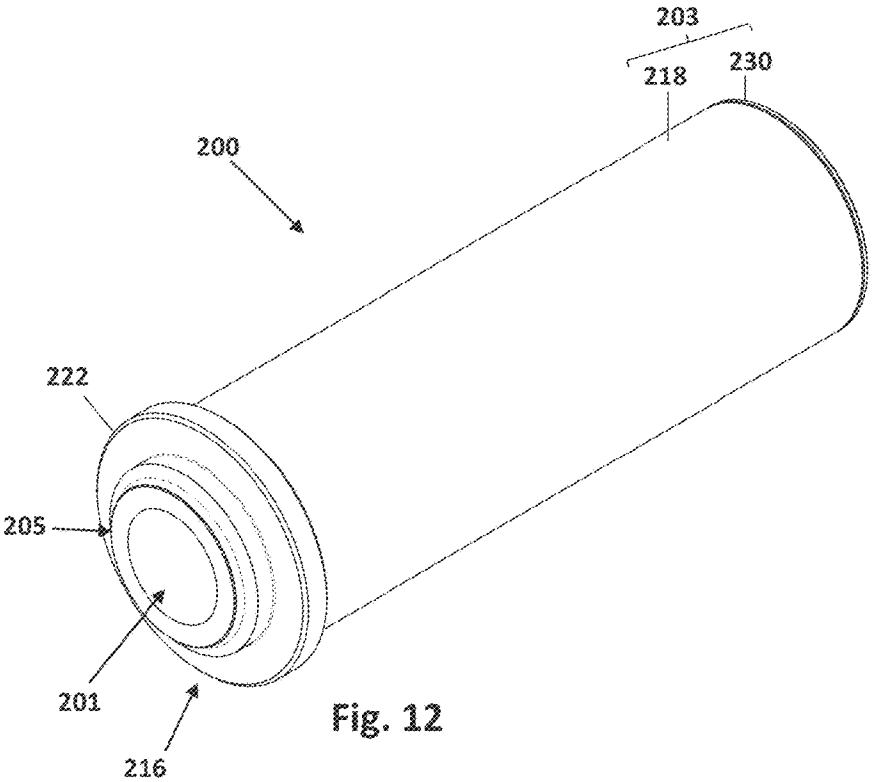
FIG. 12 illustrates a rear-perspective view of a second example suppressor in accordance with some embodiments of the present disclosure.
Figure 13:
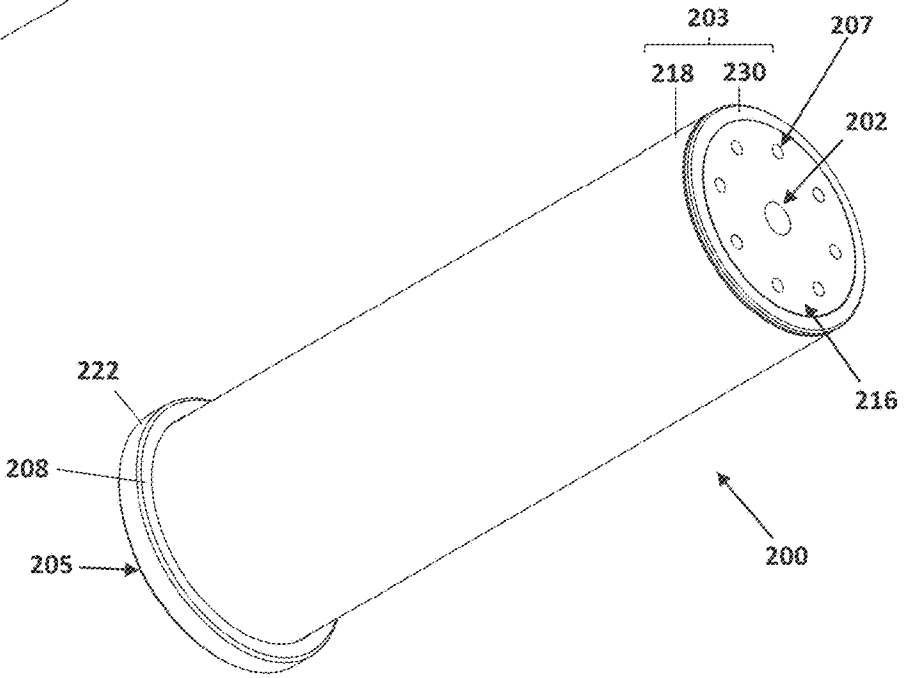
FIG. 13 illustrates a front-perspective view of the suppressor of FIG. 12 in accordance with some embodiments of the present disclosure.

In the example embodiment, the baffles 112 are configures to direct propellent gas towards the external shroud 103 walls, the top surfaces of the inner body 124, the bottom surface of the inner body 125, and/or towards at least one or more secondary chamber(s) 119. In FIG. 10, example flow lines are shown of a few possible travel paths for the propellant gas. Lines shown intersecting structure may pass laterally in front of or behind such structure. As shown and described below, the inner body 116 may be open on its lateral sides (relative to the depicted orientation, although the in-use orientation may vary in some embodiments) to allow gas to escape the inner body 116 and travel out the secondary opening and/or the additional openings via one or more voids between these open sides of the inner body 116 and the external shroud 103, as illustrated in the example of FIG. 11, which depicts a large void along either side of the inner body 113 within the shroud 103. The baffles 112 may be contoured to reduce the speed at which the propellent gas travels, which may reduce the temperature, pressure, and velocity of the gas, and the noise level that the firearm produces. In one or more example embodiments, the expansion chamber 111 may have a larger volume than one or more secondary chamber(s) 119. The one or more secondary chamber(s) 119 may be defined as the volume/region between two baffles 112, the top surface 124 of the inner body 116, the bottom surface of the inner body 125, and the walls of the external shroud 103, and/or the front of the inner body 117.

In one or more embodiments, when the firearm is discharged, some portion of the gas may be captured by one or more gas ports in the barrel and redirected to the action for cycling the firearm or may be released via other openings on the firearm (e.g., in an autoloading firearm, such as the AR-15 platform weapons). A remaining portion of the propellent gas moves from the muzzle opening 101 into the expansion chamber 111. The propellent gases may expand and fill the volume of the expansion chamber 111. Some propellent gases may expand further along the projectile path 126 through the opening 11 of the baffle(s) 112 into one or more secondary chamber(s) 119. For example, some propellent gases may expand within the expansion chamber 111 and may be directed towards the base or the inner body and/or into the secondary openings in the space between the chamber(s) and the shroud walls (e.g., cylindrical sleeve 118), which may flow out through the exit opening 102, and/or one or more additional openings 107, and/or through the secondary opening(s) at the rear groove 123. In some embodiments, some propellent gas may expand along the projectile path 126 towards one or more secondary chamber(s) 119 and/or flow out through one or more additional opening(s) 107 on the front portion 104 of the suppressor 100 via any of the chambers and voids.

As shown in FIGS. 5-9, the example embodiment may have a groove 123 bounded by the lip 108 on the outside and the flange of the base portion 122, which creates a secondary opening that may be the whole gap between the external shroud 10 and the inner body 116. The groove may be configured to expand or contract with the inner body 116 as a function of the temperature of the inner body. In the example embodiment, the external shroud 103 may at least partially cover the inner body 116 such that the proximal end of the cylindrical sleeve 118 at least partially fits in the groove 123 of the flange 122 of the base portion 105 of the inner body 116. In the depicted embodiment, the external shroud 103 engages the inner body 116 at the distal protrusion 121, and a threaded fastener (e.g., nut) 106 is then configured to engage the distal threading 113 to further secure the shroud 103 between the nut 106 and the inner body 116 via a front lip portion 109 of the shroud, which front lip portion 109 may be compressed between the wall of the inner body 116 adjacent the distal-most chamber 119 and the nut 106. In some embodiments, either the threading on the shroud or the nut may be used separately without the other. In some embodiments, the shroud 103 may be secured to the distal threading 113 without the use of the threaded fastener (e.g., nut). In some embodiments, threading on both the shroud and the nut may be used. As propellent gas enters from the muzzle opening 101 towards the distal end of the exit opening 102 following the projectile's path 126, the propellent gas enters the expansion chamber 111 and/or at least one secondary chamber 119. The propellent gas has a temperature that is greater than room temperature. As the propellent gas enters the expansion chamber 111 and/or secondary chamber 119, the external shroud 103 may also heat and enlarge, increasing the size of the secondary opening by creating a larger gap between the proximal end of the shroud and the flange 122 and groove 123. In some embodiments, the thickness of at least the cylindrical sleeve 118 of the external shroud 103 may be less than a width of the groove 123 such that the secondary opening may be defined around the end of the cylindrical sleeve within the groove.

Turning to FIGS. 12-16, another embodiment of a suppressor 200 is shown. Except as described or illustrated otherwise herein, the depicted suppressor 200 is structured and functions substantially the same as the suppressor 100 shown and described with respect to FIGS. 1-11. For example, referring to FIGS. 12-13, the suppressor 200 includes a muzzle opening 201 and exit opening 202 extending between respective proximal and distal ends of the suppressor. The suppressor 200 comprises an external shroud 203 engaged with an inner body 216. The external shroud 203 and the inner body 216 are separable (e.g., via threading in the depicted embodiment) to facilitate cleaning, repair, and/or part replacement.

Figure 14:
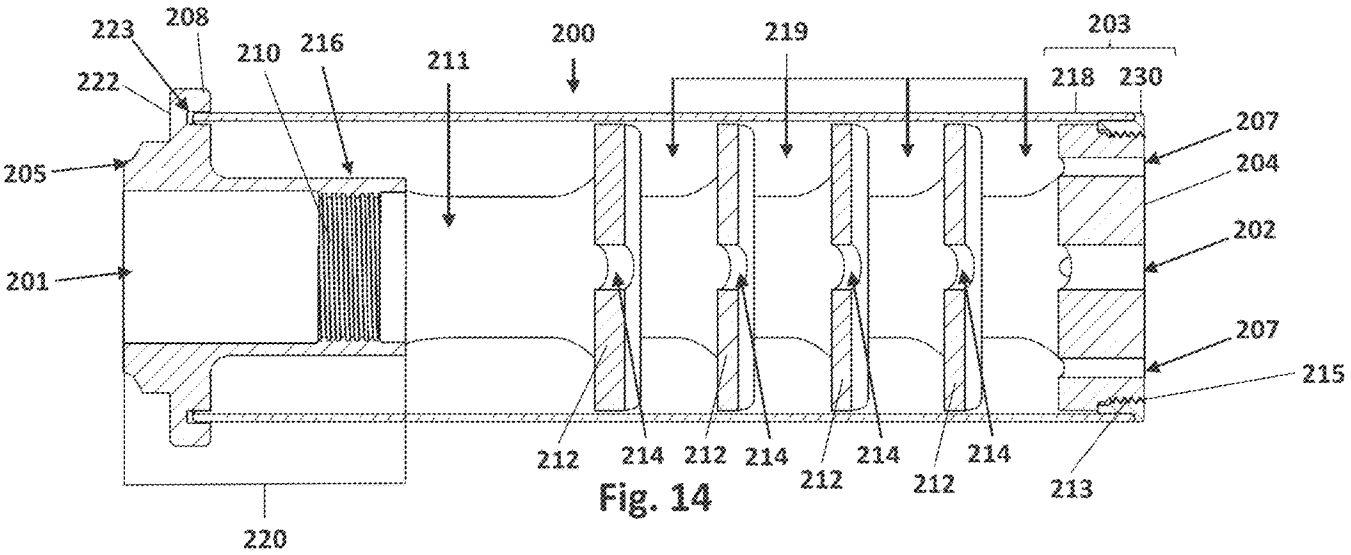
FIG. 14 illustrates a cross-sectional view of the suppressor of FIG. 12 in accordance with some embodiments of the present disclosure.
Figure 15:
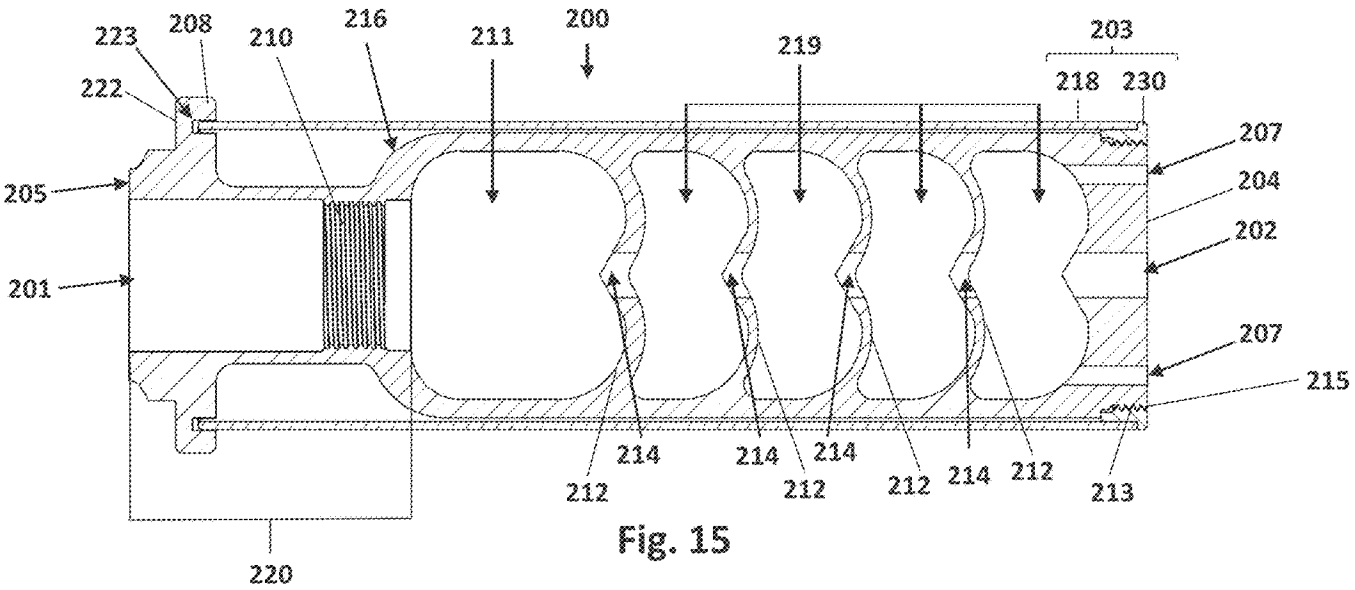
FIG. 15 illustrates a cross-sectional view of the suppressor of FIG. 12 taken ninety degrees rotated relative to the view shown in FIG. 14 in accordance with some embodiments of the present disclosure.

Referring to FIGS. 14-15, the inner body 216 may define an attachment portion 220 configured to engage the muzzle of the firearm (e.g., via threading 210). The inner body 216 may include a plurality of baffles 212 spaced axially along a portion of the length of the inner body downstream (e.g., closer to a distal end of the inner body) relative to the attachment portion 220. In conjunction with the cylindrical sleeve 218, the inner body 216 may define an expansion chamber 211 between the attachment portion (e.g., a muzzle engagement portion) 220 and a first baffle 212. Similarly, the cylindrical sleeve 218 and the inner body 216 may cooperate to define secondary chambers 219 downstream of the expansion chamber 211 and fluidically connected at least by the openings 214 in the baffles. In the depicted embodiment, baffles 212 are curved with concave shapes on either side of a central opening 214 within the cross-sectional plane shown in FIG. 15. Comparing FIGS. 14 and 15, it can be seen that the inner body 216 defines a bilateral symmetry (ignoring immaterial variations, such as the shape of the threading) or approximately bilateral symmetry with the secondary chambers 219 being open to the inner wall of the cylindrical sleeve in two opposing directions and closed in another two opposing directions perpendicular to the first two opposing directions.

Similar to the embodiment of FIGS. 1-11, the depicted embodiment of FIGS. 12-16, with reference specifically to FIGS. 14-15, includes a convoluted flow path (e.g., one or more flow directional convolutions) through a secondary opening through which additional propellant gas can exit the suppressor 200 under at least some circumstances to reduce pressure and/or heat within the suppressor and reduce fatigue and failure of the suppressor. A base portion 205 of the suppressor 200 may include a flange 222 defining a groove 223 therein that may be configured to receive the proximal end of the cylindrical sleeve 218. The groove 223 may be at least partially defined by a lip 208 along an outer periphery of the flange 222. Various other configurations of groove may be possible, including additional flow directional convolutions and/or a deeper groove to alter the flow exiting the suppressor. In some embodiments, the groove 223 may permit the propellant gas to flow between the external shroud 203 and the inner body 216 to define the secondary opening. For example, in the depicted embodiment, the secondary opening is an annular gap between the external shroud 203 and the inner body 216 which forms a convoluted flow path through the groove 223 around the proximal end of the cylindrical sleeve 218. As with the various other embodiments herein, the inner body 216 and/or cylindrical sleeve 218 may be formed of a material that is configured to expand when heated relative to the contacting portions of the other of the cylindrical sleeve 218 and/or the inner body 216 to thereby increase the area of the annular gap and permit greater propellant gas flow through the annular gap at higher temperatures.

Figure 16:
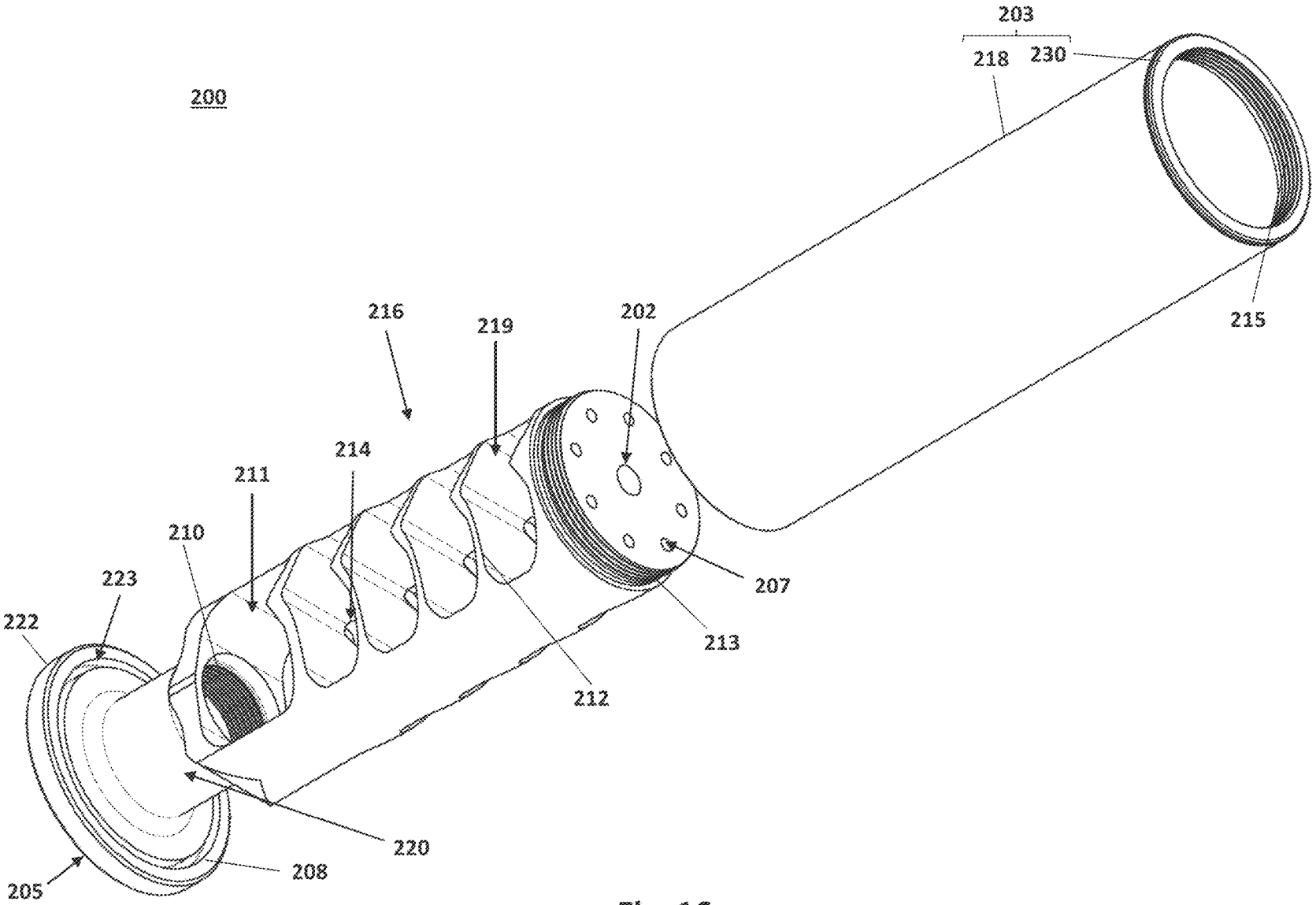
FIG. 16 illustrates an exploded view of the suppressor of FIG. 12 in accordance with some embodiments of the present disclosure.
Figure 17:
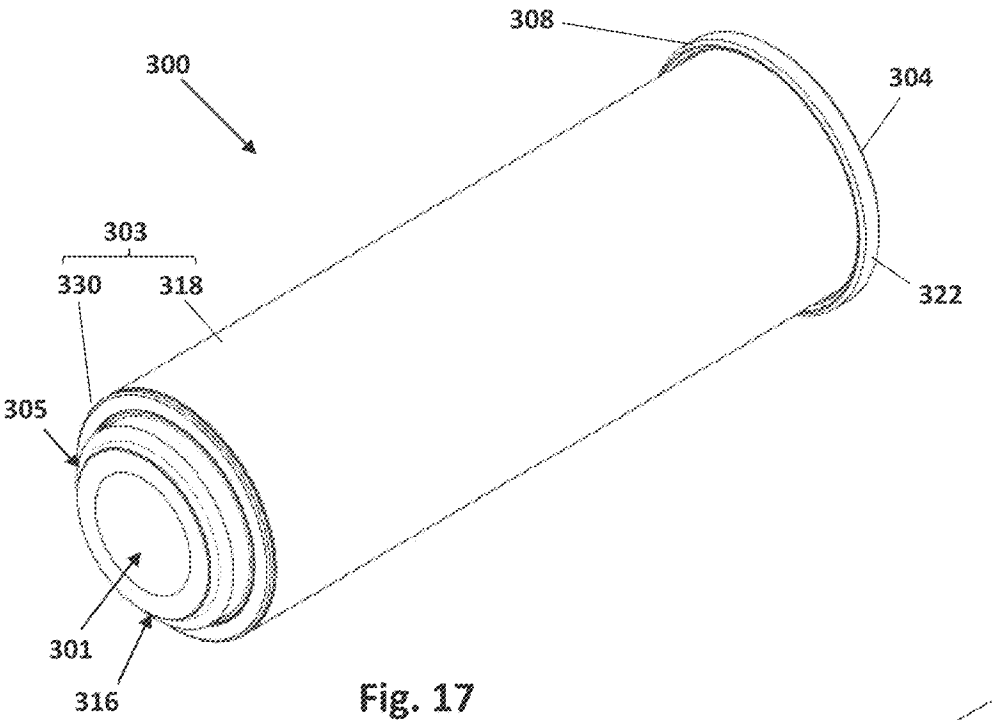
FIG. 17 illustrates a rear-perspective view of a second example suppressor in accordance with some embodiments of the present disclosure.
Figure 18:
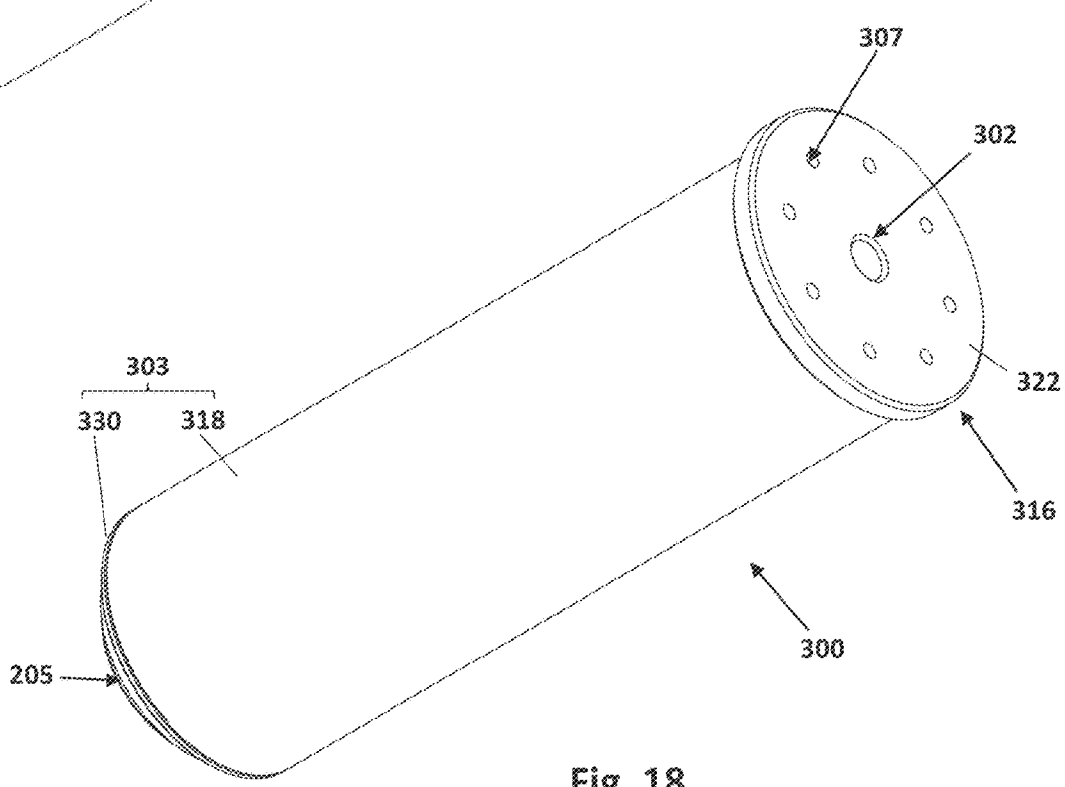
FIG. 18 illustrates a front-perspective view of the suppressor of FIG. 17 in accordance with some embodiments of the present disclosure.

With reference to FIGS. 14-16, the external shroud 203 may include a cylindrical sleeve 218 connected to a front collar portion 230. The front collar portion 230 may be integral with (e.g., a single monolithic component) or separately attached to (e.g., via welding, adhesive, fasteners, or the like) the cylindrical sleeve 218. The front collar portion 230 may include threads 215 or other fastening structure configured to engage corresponding threads 213 or corresponding fastening structure of the inner body 216. In some embodiments, the external shroud 203 may be manufactured by first machining (e.g., via subtractive manufacturing) the threading 215 into the interior circumference of the front collar portion 230 and subsequently attaching the front collar portion 230 to the cylindrical sleeve 218. In some embodiments, the threading 215 may be machined into the front collar portion 230 following attachment of the front collar portion and the cylindrical sleeve 218, or in embodiments having a monolithic structure, the threading 215 may be machined into the monolithic structure.

In the depicted embodiment, the inner body 216 includes the additional openings 207 in a front end portion 204 thereof. Similar to the embodiment of FIGS. 1-11, the additional openings 207 may be configured to permit at least a portion of the propellant gasses exiting the muzzle to exit the suppressor 200 in addition to the exit opening 202, which may, by way of non-limiting example, provide improved cooling and reduce the likelihood of fatigue or failure of the suppressor. The engagement of the threading 213, 215 of the inner body 216 and the external shroud 203 may prevent propellent gas from exiting between the inner body and external shroud at the distal end of the suppressor 200.

In the embodiment shown in FIGS. 12-16 (and the embodiments of FIGS. 17-21 described below), the additional openings 207 connect the distalmost secondary chamber 219 with the exterior of the suppressor 200. In addition, the depicted baffles 212 are shaped to generally follow the cylindrical interior of the cylindrical sleeve 218, such that at least a majority if not substantially all of the propellant exiting the suppressor passes through the openings 214 of the baffles 212. In some embodiments, at least some bypass of the baffles 212 may occur around the outer perimeter of the baffles (e.g., between the baffles and the inner wall of the cylindrical sleeve 218). In the depicted embodiment, in which the additional openings 207 are connected to the distalmost secondary chamber 219, this bypass gas flow may travel around at least one baffle before rejoining the main flow in the distalmost secondary chamber. While the baffles 212 are three dimensional structures with radially and axially varying shapes, an orthographic projection of the baffles 212 onto a two-dimensional plane perpendicular to the longitudinal axis extending between the distal end and the proximal end of the suppressor 200 may define a circular shape. The diameter of the circular shape may be the same or within 5% smaller than the internal diameter of the cylindrical sleeve 218.

With continued reference to FIGS. 14-15, the front end portion 204 of the depicted inner body 216 is flush with the distal end of the front collar portion 230, such that the suppressor 200 comprises a flat distal end. The exit opening 202 and additional openings 207 may each terminate at the front end portion 204 of the inner body 216, and thus, in the depicted embodiment, the distalmost end of the suppressor 200.

The distal end of the inner body 216 may define a recess in which the threading 213 of the inner body 216 is formed as shown in FIGS. 14-16. The depicted front collar portion 230 thereby includes a narrower diameter than the widest diameter of the inner body 216, such that the front collar portion 230 may be configured to thread onto the narrower recess of the inner body 216 and abut or otherwise stop short of the raised lip formed at the proximal end of the recess as shown in FIGS. 14-15. As such, in some embodiments, the suppressor 200 may be assembled by sliding the external shroud 203 over the inner body 216 by inserting the distal end of the inner body into the shroud first. The flange 222 may have a greater diameter than the external shroud 203 such that the proximal end of the cylindrical sleeve 218 may engage the groove 223 as the threading 213, 215 between the inner body 216 and the external shroud 203 is twisted into final position. As with the other various embodiments herein, in some embodiments, the threading 213, 215 may be the only means of axially fixing the external shroud 203 relative to the inner body 216 (e.g., the groove 223 and cylindrical sleeve 218 may contact each other in some instances, but may not rigidly hold each other in the axial direction in some embodiments).

Turning to FIGS. 17-21, another embodiment of a suppressor 300 is shown. Except as described or illustrated otherwise herein, the depicted suppressor 300 is structured and functions substantially the same as the suppressor 100 shown and described with respect to FIGS. 1-11. For example, referring to FIGS. 17-18, the suppressor 300 includes a muzzle opening 301 and exit opening 302 extending between respective proximal and distal ends of the suppressor. The suppressor 300 comprises an external shroud 303 engaged with an inner body 316. The external shroud 303 and the inner body 316 are separable (e.g., via threading in the depicted embodiment) to facilitate cleaning, repair, and/or part replacement.

Figure 19:
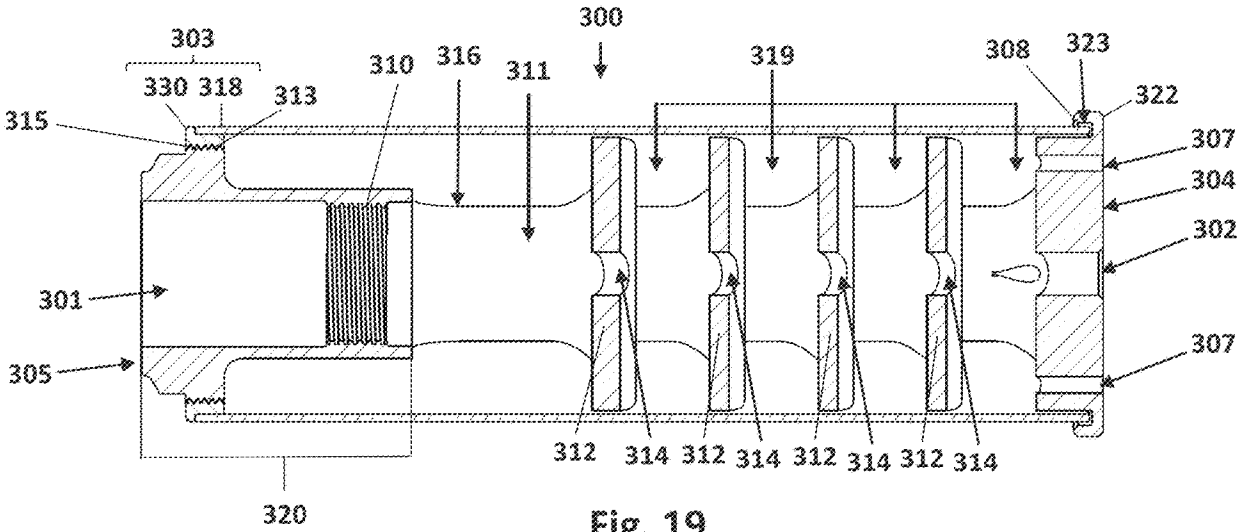
FIG. 19 illustrates a cross-sectional view of the suppressor of FIG. 17 in accordance with some embodiments of the present disclosure.
Figure 20:
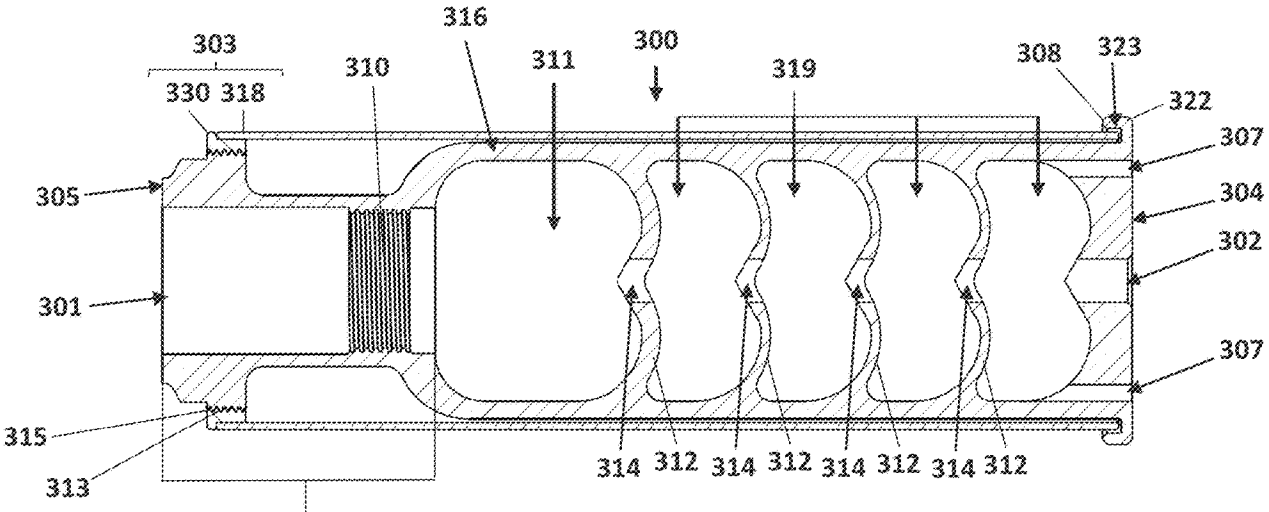
FIG. 20 illustrates a cross-sectional view of the suppressor of FIG. 17 taken ninety degrees rotated relative to the view shown in FIG. 19 in accordance with some embodiments of the present disclosure.

Referring to FIGS. 19-20, the inner body 316 may define an attachment portion 320 configured to engage the muzzle of the firearm (e.g., via threading 310). The inner body 316 may include a plurality of baffles 312 spaced axially along a portion of the length of the inner body downstream (e.g., closer to a distal end of the inner body) relative to the attachment portion 320. In conjunction with the cylindrical sleeve 318, the inner body 316 may define an expansion chamber 311 between the attachment portion (e.g., a muzzle engagement portion) 320 and a first baffle 312. Similarly, the cylindrical sleeve 318 and the inner body 316 may cooperate to define secondary chambers 319 downstream of the expansion chamber 311 and fluidically connected at least by the openings 314 in the baffles. In the depicted embodiment, the baffles 312 are curved with concave shapes on either side of a central opening 314 within the cross-sectional plane shown in FIG. 20. Comparing FIGS. 19 and 20, it can be seen that the inner body 316 defines a bilateral symmetry (ignoring immaterial variations, such as the shape of the threading) or approximately bilateral symmetry with the secondary chambers 319 being open to the inner wall of the cylindrical sleeve in two opposing directions and closed in another two opposing directions perpendicular to the first two opposing directions.

Similar to the embodiment of FIGS. 1-11, the depicted embodiment of FIGS. 17-21, with reference specifically to FIGS. 19-20, includes a convoluted flow path (e.g., one or more flow directional convolutions) through a secondary opening through which additional propellant gas can exit the suppressor 300 under at least some circumstances to reduce pressure and/or heat within the suppressor and reduce fatigue and failure of the suppressor. In the embodiment of FIGS. 17-21, the secondary opening is defined at the distal end rather than the proximal end of the suppressor. Thus, in the embodiment of FIGS. 17-21, all propellant gas may exit at or proximate the distal end of the suppressor 300. The distal end of the inner body 316 of the suppressor 300 may include a flange 322 defining a groove 323 therein that may be configured to receive the distal end of the cylindrical sleeve 318. In the depicted embodiment, the flange 322 forms part of the front end portion 304 of the inner body 316. The groove 323 may be at least partially defined by a lip 308 along an outer periphery of the flange 322. In some embodiments, the groove 323 may permit the propellant gas to flow between the external shroud 303 and the inner body 316 to define the secondary opening. For example, in the depicted embodiment, the secondary opening is an annular gap between the external shroud 303 and the inner body 316 which forms a convoluted flow path through the groove 323 around the distal end of the cylindrical sleeve 218. As described herein in regards to various other embodiments, the inner body 316 and/or cylindrical sleeve 318 may be formed of a material that is configured to expand when heated relative to the contacting portions of the other of the cylindrical sleeve 318 and/or the inner body 316 to thereby increase the area of the annular gap and permit greater propellant gas flow through the annular gap at higher temperatures.

Figure 21:
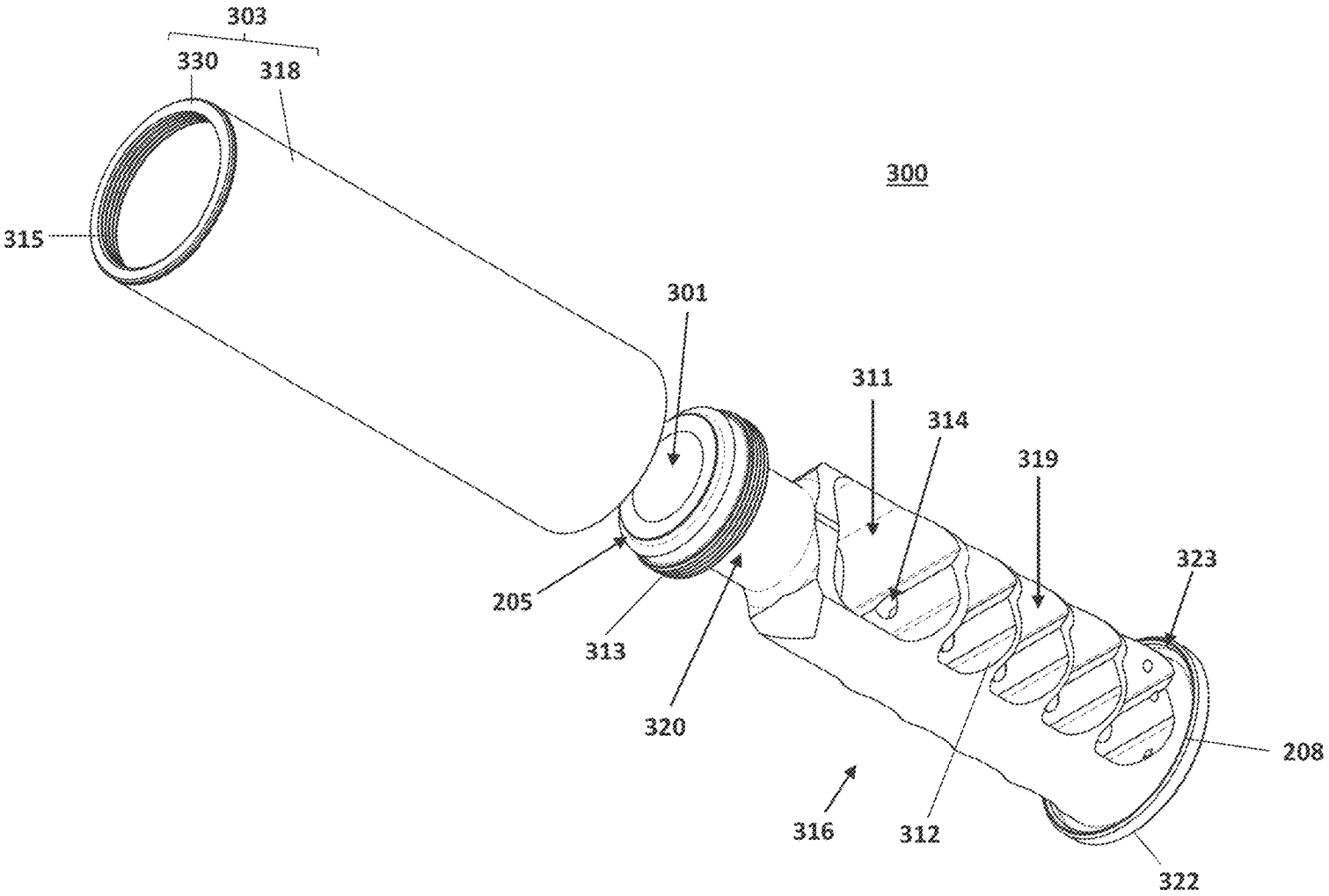
FIG. 21 illustrates an exploded view of the suppressor of FIG. 17 in accordance with some embodiments of the present disclosure.

With reference to FIGS. 19-21, the external shroud 303 may include a cylindrical sleeve 318 connected to a rear collar portion 330. The rear collar portion 330 may be integral with (e.g., a single monolithic component) or separately attached to (e.g., via welding, adhesive, fasteners, or the like) the cylindrical sleeve 318. The rear collar portion 330 may include threads 315 or other fastening structure configured to engage corresponding threads 313 or corresponding fastening structure of the inner body 316. In some embodiments, the external shroud 303 may be manufactured by first machining (e.g., via subtractive manufacturing) the threading 315 into the interior circumference of the rear collar portion 330 and subsequently attaching the rear collar portion 330 to the cylindrical sleeve 318. In some embodiments, the threading 315 may be machined into the rear collar portion 330 following attachment of the front collar portion and the cylindrical sleeve 318, or in embodiments having a monolithic structure, the threading 315 may be machined into the monolithic structure.

In the depicted embodiment, the inner body 316 includes the additional openings 307 in a front end portion 304 thereof. Similar to the embodiment of FIGS. 1-11, the additional openings 307 may be configured to permit at least a portion of the propellant gasses exiting the muzzle to exit the suppressor 300 in addition to the exit opening 302, which may, by way of non-limiting example, provide improved cooling and reduce the likelihood of fatigue or failure of the suppressor. The engagement of the threading 313, 315 of the inner body 316 and the external shroud 303 may prevent propellent gas from exiting between the inner body and external shroud at the proximal end of the suppressor 300.

In the embodiment shown in FIGS. 17-21 (and the embodiments of FIGS. 12-16 described above), the additional openings 307 connect the distalmost secondary chamber 319 with the exterior of the suppressor 300. In addition, the depicted baffles 312 are shaped to generally follow the cylindrical interior of the cylindrical sleeve 318, such that at least a majority if not substantially all of the propellant exiting the suppressor passes through the openings 314 of the baffles 312. While the baffles 312 are three dimensional structures with radially and axially varying shapes, an orthographic projection of the baffles 312 onto a two-dimensional plane perpendicular to the longitudinal axis extending between the distal end and the proximal end of the suppressor 300 may define a circular shape. The diameter of the circular shape may be the same or within 5% smaller than the internal diameter of the cylindrical sleeve 318.

With continued reference to FIGS. 19-20, the front end portion 304 of the depicted inner body 316 is flush with the distal end of the rear collar portion 330, such that the suppressor 300 comprises a flat distal end. The exit opening 302 and additional openings 307 may each terminate at the front end portion 304 of the inner body 316, and thus, in the depicted embodiment, the distalmost end of the suppressor 300.

The base end 305 of the inner body 316 may define an outer circumference or other outwardly facing surface on which the threading 313 of the inner body 316 may be formed as shown in FIGS. 19-21. The depicted rear collar portion 330 thereby includes a wider diameter than the widest diameter of the base end 305, such that the rear collar portion 330 may be configured to thread onto the inner body 316. As such, in some embodiments, the suppressor 300 may be assembled by sliding the external shroud 303 over the inner body 316 by inserting the proximal end of the inner body into the shroud first. The flange 322 may have a greater diameter than the external shroud 303 such that the distal end of the cylindrical sleeve 318 may insert into and, in some instances, engage one or more surfaces of groove 323 as the threading 313, 315 between the inner body 316 and the external shroud 303 is twisted into final position. As with the other various embodiments herein, in some embodiments, the threading 313, 315 may be the only means of axially fixing the external shroud 303 relative to the inner body 316 (e.g., the groove 323 and cylindrical sleeve 318 may contact each other in some instances, but may not rigidly hold each other in the axial direction in some embodiments). In the depicted embodiment of FIGS. 16-23, the threading 313, 315 engagement between the external shroud 303 and the inner body 316 is proximate the threading 310 of the muzzle attachment portion 320.

While the foregoing embodiments are described separately as example embodiments, it should be understood that the various components, features, and functionalities of each embodiment may be combined or interchanged with each other.

The embodiments described herein may also be scalable to accommodate at least the aforementioned applications such as with respect to different size and configurations of firearms, different type of cartridges, and different sizes (e.g., lengths and diameters) of suppressors. Various components of embodiments described herein can be added, removed, reorganized, modified, duplicated, and/or the like as one skilled on the art would find convenient and/or necessary to implement a particular application in conjunction with the teachings of the present disclosure. Moreover, specialized features, characteristics, materials, components, and/or equipment may be applied in conjunction with the teaching of the present disclosures as one skilled in the art would find convenient and/or necessary to implement a particular application in light of the present disclosure.

Many modifications and other embodiments of the present disclosure set forth herein will come to mind to one skilled in the art to which this disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated, in light of the present disclosure, that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purposes of limitation.

What is claimed is:

1. A suppressor for a firearm defining a distal end and a proximal end, the suppressor comprising:

an inner body comprising:

a muzzle attachment portion; and a plurality of baffles each defining an opening, wherein the openings of the plurality of baffles collectively define a linear projectile path through the inner body along an axis extending from the proximal end of the suppressor to the distal end of the suppressor defining an exit opening, wherein an expansion chamber is defined between the muzzle attachment portion and one of the plurality of baffles; and an external shroud configured to removably couple to and at least partially cover the inner body, wherein the external shroud is configured to permit at least a portion of propellent gas within the inner body to exit the suppressor via a secondary opening defined between the inner body and the external shroud, wherein the inner body defines a flange that defines a circumferential groove that is configured to receive a proximal end of the external shroud, wherein the flange defines a labyrinth structure configured to define one or more flow directional convolutions between the flange and the external shroud, and wherein the proximal end of the external shroud is inserted into the circumferential groove.

2. The suppressor according to claim 1, wherein the external shroud comprises threading configured to engage the inner body.

3. The suppressor according to claim 1, further comprising one or more additional openings at the distal end of the suppressor.

4. The suppressor according to claim 3, wherein the one or more additional openings are oriented linearly forward and parallel to the linear projectile path and fluidically connected to the expansion chamber.

5. The suppressor according to claim 3, wherein the one or more additional openings are defined in the inner body.

6. The suppressor according to claim 1, wherein the inner body is open on at least one side such that the inner body is configured to permit the portion of propellant gas to exit the inner body towards the external shroud.

7. The suppressor according to claim 1, wherein the external shroud comprises a threaded portion at a distal end thereof that engages the inner body.

8. The suppressor according to claim 1, wherein the secondary opening is defined between the proximal end of the external shroud and the flange.

9. The suppressor according to claim 1, wherein the flange defines a flange diameter perpendicular to the axis, the flange diameter being greater than a greatest diameter of the external shroud.

10. A firearm comprising:

a barrel; and the suppressor of claim 1 attached to the barrel.

11. The suppressor according to claim 1, wherein the external shroud comprises a cylindrical sleeve and a front collar portion, a distal end of the cylindrical sleeve being connected to the front collar portion, the front collar portion comprising threads configured to engage corresponding threads of the inner body, wherein the inner body comprises a front end portion that defines one or more additional openings, and wherein the front end portion of the inner body is flush with a distal end of the front collar portion, such that the suppressor comprises a flat distal end.

12. A suppressor for a firearm defining a distal end and a proximal end, the suppressor comprising:

an inner body comprising:

a muzzle attachment portion; and a plurality of baffles each defining an opening, wherein the openings of the plurality of baffles collectively define a linear projectile path through the inner body along an axis extending from the proximal end of the suppressor to the distal end of the suppressor defining an exit opening, wherein an expansion chamber is defined between the muzzle attachment portion and one of the plurality of baffles; and an external shroud configured to removably couple to and at least partially cover the inner body, wherein the external shroud is configured to permit at least a portion of propellent gas within the inner body to exit the suppressor via a secondary opening defined between the inner body and the external shroud, wherein the inner body defines a flange that defines a circumferential groove that is configured to receive a distal end of the external shroud, wherein the flange defines a labyrinth structure configured to define one or more flow directional convolutions between the flange and the external shroud, and wherein the distal end of the external shroud is inserted into the circumferential groove.

13. The suppressor according to claim 12, wherein the flange is disposed at a distal end of the inner body.

14. The suppressor according to claim 13, wherein the flange at least partially defines a distal end surface at the distal end of the inner body, the distal end surface further comprising the exit opening.

15. The suppressor according to claim 12, wherein the inner body defines a threaded portion extending circumferentially about a portion of the muzzle attachment portion.

16. The suppressor according to claim 12, wherein the external shroud comprises a cylindrical sleeve and a rear collar portion, a proximal end of the cylindrical sleeve being connected to the rear collar portion.

17. The suppressor according to claim 16, the rear collar portion comprising threads configured to engage corresponding threads of the inner body.

18. The suppressor according to claim 17, wherein the flange has a greater diameter than the external shroud, wherein a distal end of the cylindrical sleeve engages one or more surfaces of the circumferential groove as the threading between the inner body and the rear collar portion of the external shroud is twisted into final position.

19. A method of assembling a suppressor, the suppressor defining a distal end and a proximal end, the suppressor comprising an inner body and an external shroud, the inner body comprising:

a muzzle attachment portion defined at or proximate the proximal end of the suppressor and a plurality of baffles each defining an opening; and a flange that defines a circumferential groove, wherein the flange defines a labyrinth structure configured to define one or more flow directional convolutions between the flange and the external shroud, the method comprising:

inserting the inner body into the external shroud until the external shroud at least partially covers the inner body and a proximal end of the external shroud is inserted into the circumferential groove of the flange of the inner body; and removably coupling the inner body to the external shroud, such that the inner body and the external shroud are fixed relative to each other, wherein the external shroud is configured to permit at least a portion of propellent gas within the inner body to exit the suppressor via a secondary opening defined between the inner body and the external shroud.

20. The method according to claim 19, wherein a distal end of the external shroud defines a threaded portion, wherein inserting the inner body into the external shroud comprises inserting the inner body into the threaded portion from the proximal end of the external shroud.

* * * * *